US008256339B1

(12) United States Patent
Hamalian et al.

(10) Patent No.: US 8,256,339 B1
(45) Date of Patent: Sep. 4, 2012

(54) MISSILE LAUNCH SYSTEM AND APPARATUS THEREFOR

(75) Inventors: Ari Hamalian, Mount Laurel, NJ (US); Alexander Cosmas, Cambridge, MA (US)

(73) Assignee: Lockheed Martin Corporation, Bethesda, MD (US)

( * ) Notice: Subject to any disclaimer, the term of this patent is extended or adjusted under 35 U.S.C. 154(b) by 1489 days.

(21) Appl. No.: 11/647,737

(22) Filed: Dec. 29, 2006

(51) Int. Cl.
*F41F 3/04* (2006.01)

(52) U.S. Cl. ..... 89/1.815

(58) Field of Classification Search ..... 89/1.8, 89/1.801, 1.802, 1.803, 1.804, 1.809, 1.81, 89/1.815, 1.816, 1.819; 244/137.3, 137.4; 24/462, 570

See application file for complete search history.

(56) References Cited

U.S. PATENT DOCUMENTS

| | | | | | |
|---|---|---|---|---|---|
| 3,967,529 | A * | 7/1976 | Ingle et al. | 89/1.819 |
| 4,444,087 | A * | 4/1984 | Hunter et al. | 89/1.802 |
| 4,545,284 | A * | 10/1985 | Piesik | 89/1.819 |
| 4,750,404 | A * | 6/1988 | Dale | 89/1.819 |
| 4,922,799 | A * | 5/1990 | Bartl et al. | 89/1.819 |
| 5,003,909 | A * | 4/1991 | Moody | 114/238 |
| 5,050,477 | A * | 9/1991 | Cowdery et al. | 89/1.802 |
| 5,094,140 | A * | 3/1992 | Williams | 89/1.819 |
| 5,098,236 | A * | 3/1992 | Fischer | 410/77 |
| 5,168,119 | A * | 12/1992 | Sands | 89/1.816 |
| 5,291,820 | A * | 3/1994 | Hainsworth et al. | 89/1.806 |
| 5,398,588 | A * | 3/1995 | Peck | 89/1.806 |
| 5,400,689 | A * | 3/1995 | Hutter et al. | 89/1.816 |
| 5,942,713 | A | 8/1999 | Basak | |
| 5,983,468 | A * | 11/1999 | Evans et al. | 24/457 |
| 6,119,982 | A * | 9/2000 | Jakubowski et al. | 244/137.4 |
| 6,152,011 | A | 11/2000 | Ivy et al. | |
| 6,250,195 | B1 * | 6/2001 | Mendoza et al. | 89/1.59 |
| 6,347,567 | B1 * | 2/2002 | Eckstein | 89/1.59 |
| 6,382,488 | B1 * | 5/2002 | Hancock | 224/547 |
| 6,929,223 | B2 * | 8/2005 | Hancock et al. | 248/74.2 |
| 2002/0053628 | A1 * | 5/2002 | Hancock et al. | 248/229.14 |
| 2002/0088902 | A1 * | 7/2002 | Griffin | 244/137.4 |

* cited by examiner

*Primary Examiner* — Bret Hayes
(74) *Attorney, Agent, or Firm* — Howard IP Law Group, PC

(57) ABSTRACT

A missile is guided and/or supported within a canister by a collapsible support structure. In one embodiment the collapsible support structure is part of a railcar running on a rail within the canister. Each railcar includes a missile-engaging guidance and/or support structure, a rail engaging element, and a hinged pantograph-like collapsible support extending between the missile-engaging structure and the rail engaging element. A hinge of the pantograph is locked in a storage state and during part of motion during the missile launch. The hinge is unlocked, and travel of the rail engaging element is stopped. The missile-engaging support structure momentarily continues its motion, and the pantograph collapses. Capture elements engage parts of the railcar or the canister during collapse to prevent rebound of the missile-engaging support structure toward the missile.

26 Claims, 19 Drawing Sheets

MISSILE LAUNCH SYSTEM AND APPARATUS THEREFOR

The invention was made with Government Support under N00024-98-C-5197 awarded by Department of the Navy. The Government has certain rights in the invention.

FIELD OF THE INVENTION

This invention relates to systems for launching missiles, and more particularly to a collapsing carriage with limited rebound.

BACKGROUND OF THE INVENTION

Canister storage and launch of missiles are well known. U.S. Pat. No. 5,942,713 issued Aug. 24, 1999 in the name of Basak describes multi-missile canister holding chambers with selective firing controls. U.S. Pat. No. 6,152,011, issued Nov. 28, 2000 in the name of Ivy et al. describes a system for controlling and independently firing different types of missiles from canisters at plural launch positions.

FIG. 1*a* is a simplified longitudinal cross-section of a canisterized missile designated generally as 10. More specifically, the illustrated canisterized missile 10 is any type that can be fired from a vertical launch system (VLS) canister. In FIG. 1*a*, the canister 12 is in the form of a wall 12*w* defining a hollow tube or missile storage region 14 centered on a longitudinal axis 8 and lying between a missile exit or egress end 12*me* and a rear or bottom end (when the canister is in its vertically oriented launch position) 12*be*. A missile 16, defining a front end $\mathbf{16}_{front}$ and a rear 16*r*, is contained within storage region 14 of canister 12 in a storage state of the structure, and the missile 16 is physically guided or supported at transverse positions or planes designated 18*a* and 18*b* by a plurality of "railcar" sets 20*a* and 20*b*. Rail car set 20*a* lies near plane 18*a* during storage, and railcar set 20*b* lies near plane 18*b*. Missile 16 carries a plurality of external aerodynamically stabilizing fins designated generally as 16F. These fins are partially folded during those times when the missile 16 is within canister 12 storage region 14, but are spring-loaded to extend as the missile 16 is launched from and leaves the missile canister 12 in a second state of the structure 10.

FIG. 1*b* is a simplified transverse cross-section of the structure of FIG. 1*a* at a location, such as 1*b*-1*b* along the canister 12 of FIG. 1*a*, partially cut away to reveal particular details. In FIG. 1*b*, an elongated rail structure of a set 32 of rail structures extends along each of the inside corners 30*a*, 30*b*, 30*c*, and 30*d* of the canister 12 tube. More particularly, a rail structure 32*a* of set 32 extends along inside corner 30*a*, a rail structure 32*b* extends along inside corner 32*b*, a rail structure 32*c* extends along inside corner 30*c*, and a rail structure 32*d* extends along inside corner 32*d*. Thus, each rail structure of set 32 of rail structures is supported by two mutually adjacent walls of canister 12. FIG. 1*c* illustrates a simplified cross-section of one rail structure of FIG. 1*b*. For definiteness, the rail structure of FIG. 1*c* is designated 32*b*. As illustrated in FIG. 1*c*, rail 32*b* defines walls 32*b*1 and 32*b*2 which are affixed to adjacent walls 12*w*1 and 12*w*2 of canister 12. Rail structure 32*b* of FIG. 1*c* also defines a rail 34*b* in the form of a recess with overhanging lips or edges 36. Elongated rail 34 is dimensioned to accommodate a rail-engaging support of a railcar. Returning now to FIG. 1*b*, each of the other rail structures 32*a*, 32*c*, and 32*d* defines a rail similar to rail 34*b* of rail structure 32*b*. Thus, rail structure 32*a* defines a rail 34*a*, rail structure 32*c* defines a rail 34*c*, and rail structure 32*d* defines a rail 34*d*.

In FIG. 1*b*, a collapsible railcar $\mathbf{20}b_2$ of set 20*b* of railcars has its rail-engaging portion (not designated) engaged with rail 34*b* of rail structure 32*b*, and railcar $\mathbf{20}b_4$ of set 20*b* of railcars has its rail-engaging portion (not designated) engaged with rail 34*d* of rail structure 32*d*. Rail cars $\mathbf{20}b_2$ and $\mathbf{20}b_4$ lie on a first diagonal relative to axis 8. Two additional railcars, which lie on the opposite diagonal, are cut away so as to reveal other details. More particularly, FIG. 1*b* shows two folded aerodynamic fins 40*a*, 40*c* of a set of four such fins, the other two of which are partially obscured by railcars 34*b* and 34*d*. The folded fin 40*a* includes a first or fixed portion $\mathbf{40}a_1$ which projects generally radially relative to axis 8, and a second portion $\mathbf{40}a_2$ which is folded away from the plane of portion $\mathbf{40}a_1$. Folded portion $\mathbf{40}a_2$ of fin 40*a* is spring-loaded to urge it into the same plane as portion $\mathbf{40}a_1$. An interior rail or wall 42*a*, elongated in a direction parallel with longitudinal axis 8, maintains folded fin portion $\mathbf{40}a_2$ in the folded position over a certain portion of the travel of the missile as it exits the canister. Folded fin 40*c* includes a first or fixed portion $\mathbf{40}c_1$ which projects generally radially relative to axis 8, and a second portion $\mathbf{40}c_2$ which is folded away from the plane of portion $\mathbf{40}c_1$. Folded portion $\mathbf{40}c_2$ of fin 40*c* is spring-loaded to urge it into the same plane as portion $\mathbf{40}c_1$. An interior rail or wall 42*c*, elongated in a direction parallel with longitudinal axis 8, maintains folded fin portion $\mathbf{40}c_2$ in the folded position over a certain portion of the travel of the missile as it exits the canister. Other interior rails or walls maintain the other folded fins in the folded positions.

FIG. 2*a* is a simplified perspective or isometric view of a railcar such as railcar 34*b* of FIG. 1*b*, partially exploded, together with a notional representation of rail structure 32*b* and rail 34*b*. The railcar of FIGS. 2*a* and 2*b* is designated generally as 200. FIG. 2*b* is a simplified side elevation view of the structure of FIG. 2*a*. As illustrated in FIGS. 2*a* and 2*b*, railcar 200 includes a rail-engaging structure or element 210 and a missile-engaging guidance and/or support structure 212, which missile-engaging structure includes a platform 214 with a missile engaging platform 216 mounted thereon. The dimensions of rail-engaging structure 210 are such that it can fit within, and slide along, a rail such as 34*b* of FIG. 1*c*. Missile engaging platform 216 bears a missile-locating button or boss 218 which registers the missile with the guide and/or support when engaged in a corresponding aperture in the missile. A linkage 220 including rear bar or element 220*r* and front bar or element 220*f* interconnects the missile-engaging structure 212 with the rail-engaging structure 210, to form or define a "four-bar linkage" 219. The term "four-bar linkage" is used freely in the domain of mechanical design and kinematics, and generally refers to a linkage including four rigid bodies (termed "bars" or "links"), each attached to two others by single joints or pivots to form a closed loop. The elements of the four-bar linkage 219 in FIGS. 2*a* and 2*b* are front and rear links 220*f* and 220*r*, and portions of rail-engaging support 210 and missile engaging platform 214 lying therebetween. The purpose of four-bar linkage 219 is to act in a manner similar to a pantograph, allowing the rail-engaging and missile-engaging platforms or structures 210, 212 to move relative to each other while remaining generally mutually parallel. A pantograph is an instrument for copying images such as plans, maps, and the like, with a fixed size reduction or augmentation. By extension, a pantograph can also be a mechanical device of generally like configuration which includes hinged links to allow motion or spacing adjustment between first and second elements joined by the links, as for example in an electric trolley or locomotive. As illustrated in FIGS. 2*a* and 2*b*, the linkage 220 includes front and rear I-beams 220*f* and 220*r*, respectively, with each I-beam taking the place of one of the links of four-bar linkage 219. Each I-beam 220*r*, 220*f* comprises a pair of flanges and a web, which may be perforated. As illustrated in the cross-section of FIG. 2*c*, I-beam 220*f* includes first and second flanges 220*ff*1 and 220*ff*2 and a web 220*fw*. Rear I-beam 220*r* is similar. Rear I-beam 220*r* is hingedly or rotationally affixed to rail-engaging structure 210 along an axis of rotation $\mathbf{208}_1$ and is affixed to missile-engaging structure 212 along an axis of rotation $\mathbf{208}_2$. Similarly, front I-beam 220*f* is hingedly affixed to rail-engaging structure 210 along an axis of rotation $\mathbf{208}_3$ and is affixed to missile-engaging structure 212 along an axis of rotation $\mathbf{208}_4$. At least one of the hinges associated with axes of rotation $\mathbf{208}_1$, $\mathbf{208}_2$, $\mathbf{208}_3$, and $\mathbf{208}_4$ of FIGS. 2*a* and 2*b* is locked against rotation in the missile storage state or condition of the canister/missile combination 10, as known in the art, by a mechanism which may be as simple as a ball-and-detent. With any one of the hinges locked, the pantograph-like four-bar linkage 219 cannot collapse. Thus, in the missile storage state of the canister/missile combination 10 of FIG. 1*a*, the missile 16 is coaxially held within missile storage region 14 by the combination of four railcars at each transverse location 18*a*, 18*b*.

During missile launch, the engine (not illustrated) of the missile is started, and the entire missile moves toward the missile egress end 12*me* of canister 12 of FIG. 1*a*, initially guided or supported by the railcars, moving on their respective rails. At a selected point along their travel toward the missile egress end of the canister, the leading set 20*b* of railcars reaches a stop which prevents further motion toward the missile egress end. Concurrently with reaching the stop, an unlocking mechanism unlocks the hinge or hinges of the four railcars of set 20*b*, as by disengaging a ball from a detent, all as known in the art. The inertia of the moving railcar and of the still-momentarily-attached missile causes the missile-engaging platform 212 to continue to move toward the egress end of the canister, while the rail-engaging platform is stopped. With the hinge(s) unlocked, the railcar begins to collapse, as illustrated in FIG. 3*a*, where the arrow 310 indicates the motion of the missile-engaging platform 212 relative to the stopped rail-engaging support 210. The direction of motion of the rear linkage 220*r* is indicated by the arrow 312. When the missile-engaging structure 212 starts to collapse toward the railcar rail-engaging support 210, the missile 16 is released, at least at that cross-section. A moment later, the missile-engaging structure 212 of the railcar collapses onto the still-stopped rail-engaging structure 210, as illustrated in FIG. 3*b*. At this time, the movement of the railcar components toward the missile egress end of the canister has stopped. The speed and inertia of the vertically-moving missile-engaging structure 212 and of the swiveling links 220*r* and 220*f*, in conjunction with the elasticity of the structural members, tends to cause the missile-engaging structure to rebound upward and in a retrograde direction, as illustrated by arrow 230 in FIG. 3*c*. It has been found that recoil or rebound of the missile-engaging portion of the railcar occurs at times at which the fins of the missile are in the vicinity. It is known that such touching can affect the orientation of the missile as it leaves the canister, a condition affecting the "tip-off" angle. Also, the rebounding missile-engaging portions of the railcar might conceivably damage the fins, although this has not been seen. FIG. 3*d* illustrates a portion of a canisterized missile 16 with its fins 16F traveling in the direction of arrow 308 relative to the stopped railcar 200. At the moment illustrated in FIG. 3*a*, the rail-engaging support 210 has reached rail stop 392, missile-engaging railcar platform 212 is moving in the direction indicated by arrow 230, and the lower fin 16Fl of the missile is about to come into contact with the missile-engaging platform element 212 of railcar 200.

In one embodiment, the links of the railcars are spring-loaded to aid in quickly moving the missile-engaging structure out of the way of the missile. The spring loading tends to increase the rebound.

Improved or alternative missile launch structures are desired.

SUMMARY OF THE INVENTION

A collapsible structure according to an aspect of the invention is for controllably guiding and/or supporting a load. The collapsible structure comprises underlying support structure, a load guiding and/or support structure, and a collapsible support arrangement extending between the underlying support structure and the load guiding and/or support structure. The collapsible support arrangement is hingedly affixed to the underlying support structure and to the load guiding and/or support structure, and together therewith defines a four-bar linkage for guiding and/or supporting the load or support structure in a position generally parallel with the underlying support structure when a hinge of the four-bar linkage is locked, and for allowing collapsing motion of the load guiding and/or support structure relative to the underlying support structure when the hinge is unlocked. According to an aspect of the invention, a capture arrangement is affixed to at least one of (a) the underlying support structure and (b) the load guiding and/or support structure, for permanently deforming in conjunction with the collapse of the four-bar linkage so as to absorb energy from the collapse of the load guiding and/or support structure toward the underlying support structure and to thereby tend to reduce rebound. In a particular embodiment of this aspect, the collapsible structure is part of a railcar in which the underlying support structure is for engaging and traveling along a rail.

According to another aspect of the invention, a missile launch arrangement comprises an elongated missile defining a front and a rear, and also defining a generally cylindrical body extending between the front and the rear. The body of the missile supports outboard structures which extend outwardly from the cylindrical body. An elongated canister defines (a) an axis, (b) an elongated storage region about the axis, and (c) a missile egress end. The elongated storage region is dimensioned to accommodate the generally cylindrical body of the missile and its outboard structures. A plurality of collapsible cars is provided, each of which includes a car support structure, a missile guidance and/or support structure, and a collapsible intermediary support lying between the car support structure and the missile guidance and/or support structure, for holding the car support structure away from the missile guidance and/or support structure in a first mode of operation, and for allowing the missile guidance and/or support structure to approach the car support structure in a second mode of operation. Each of the collapsible cars lies between at least one wall of the storage region and the cylindrical body of the missile, with the car support structure adjacent the at least one wall of the storage region. The cars, acting together in the first mode of operation, guide or support the body of the missile generally centered about the axis in the storage region. This guidance and/or support extends to the time at which the missile travels toward the egress end of the canister. Each of the intermediary supports of the collapsible cars is arranged for collapsing in conjunction with a transition between the first mode of operation and the second mode of operation when the associated car reaches a particular travel position along the storage region of the canister. Capture means are provided. The capture means are one of (a) affixed to one of (i) the car support structure and (ii) the missile guidance and/or support structure, for capturing the intermediary support during the transition, thereby tending to prevent substantial rebounding motion of the intermediate support and the missile guidance and/or support structure toward the missile body, and (b) affixed to the at least one wall of the storage region and to the missile support structure, for mutual capture during the transition, thereby tending to reduce rebounding motion of the missile support structure toward the missile body. In one embodiment of this aspect of the invention, the capture means comprise mutually mating elements which permanently deform during mating to thereby absorb energy and establish permanent capture. In another embodiment the capture means comprise hooked elements for capturing a portion of the intermediate support.

A collapsible structure according to an aspect of the invention is for controllably supporting a load. The collapsible structure comprises underlying support structure and a load bearing support structure. A collapsible support arrangement extends between the underlying support structure and the load bearing support structure. The collapsible support arrangement includes a four-bar linkage hingedly affixed to the underlying support structure and to the load bearing support structure, for supporting the load bearing support structure in a position generally parallel with the underlying support structure when a hinge of the four-bar linkage is locked, and for allowing motion of the load bearing support structure relative to the underlying support structure and to collapse toward the underlying support structure. A capture arrangement is affixed to at least one of the underlying support structure and the load bearing support structure, for elastically deforming in conjunction with the collapse of the four-bar linkage so as to capture the four-bar linkage and prevent rebounding motion of the four-bar linkage. In a particular embodiment, the collapsible structure is part of a railcar in which the underlying support structure is for engaging and traveling along a rail.

A missile launch arrangement according to an aspect of the invention comprises an elongated missile. The missile defines a front and a rear, and also defines a generally cylindrical body generally about a longitudinal axis and extending between the front and the rear. The body of the missile supports outboard structures which extend outwardly from the cylindrical body. In one embodiment, the outboard structures include folded fins. The missile launch arrangement also includes an elongated canister including at least one wall defining (a) an elongated storage region about the longitudinal axis between a missile egress end and a back end. The elongated storage region is dimensioned to accommodate the generally cylindrical body of the missile and its outboard structures in a first state. A plurality of collapsible rail cars is provided. Each of the collapsible rail cars includes a rail-engaging structure, a missile support structure, and a collapsible intermediary support lying between the rail engaging structure and the missile support structure. The intermediary support may be in the general form of a pantograph. The collapsible intermediary support is for holding the rail engaging structure away from the missile support structure in the storage state, and for allowing the missile support structure to approach the rail engaging structure in a second state. Each of the collapsible rail cars lies between at least one wall of the storage region and the cylindrical body of the missile, with the rail engaging structure adjacent the at least one wall of the storage region. The rail cars, acting together in the storage state, support the body of the missile generally centered about the axis in the storage region as the missile travels toward the egress end of the canister. The intermediary supports of each of the collapsible rail cars are arranged for collapsing in conjunction with a transition between the first state and the second state when the associated rail car reaches a particular travel position along the storage region of the canister. Capture means are provided. The capture means are one of (a) affixed to at least one of (i) the rail car rail engaging structure and (ii) the missile support structure, for capturing the intermediary supports during the transition, thereby tending to prevent substantial rebounding motion of the intermediate supports and the missile support structure toward the missile body, and (b) affixed to at least one wall of the storage region and to the missile support structure, for mutual capture during the transition, thereby tending to reduce rebounding motion of the missile support structure toward the missile body. In a particular version of this missile launch arrangement, the rail engaging structure stops moving toward the missile exit at the particular travel position while the missile support structure continues to move with a component of motion toward the missile exit.

In a particular embodiment of a missile launch arrangement, the capture means comprises at least one capture link including a base connected to the one of (i) the rail engaging structure and (ii) the missile support structure and also including a hook portion dimensioned to engage a portion of the intermediary support during the transition between the first state and the second state. The intermediary support may include at least one elongated support member, and the hook portion may be dimensioned to engage an edge portion of the elongated support member of the intermediary support during the transition. In an alternative embodiment, the intermediary support includes at least one elongated support member defining an aperture, and the hook portion is dimensioned to engage the aperture.

In another version of the missile launch arrangement, the capture means is affixed to one of (i) the rail engaging structure and (ii) the missile support structure, and the capture means comprises at least one capture link including a base connected to the one of (i) the rail car support structure and (ii) the missile support structure and also including an enlarged head portion dimensioned to engage a portion of the intermediary support during the transition. In yet another version, the capture means comprises first and second mutually mating halves of a deformable energy absorption device, the first half of the energy absorption device being affixed to the at least one wall of the storage region and the second half of the energy absorption device being affixed to the missile support structure, for mutual capture and deformation during the transition, thereby tending to reduce rebounding motion of the missile support structure toward the missile body.

Figure 1A:
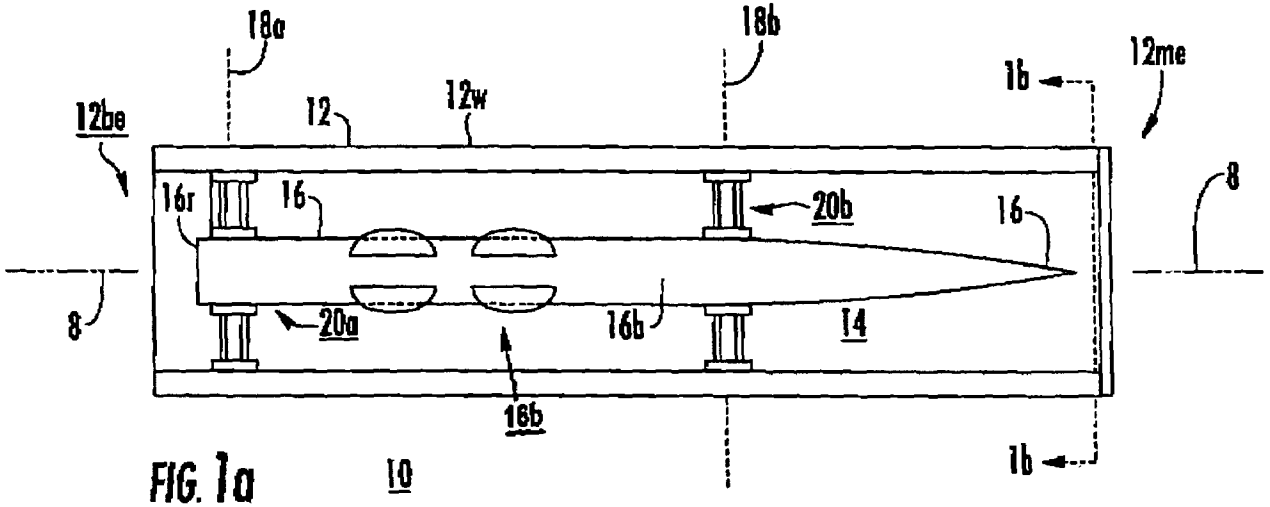
FIG. 1*a* is a simplified longitudinal cross-sectional view of a canisterized missile in the storage condition or state.
Figure 1B:
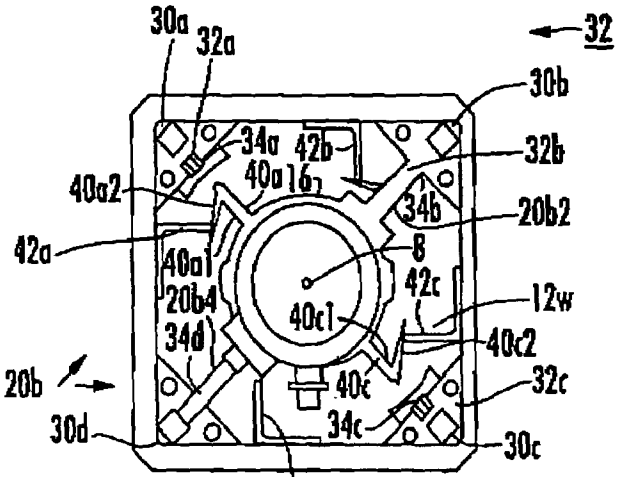
FIG. 1*b* is a simplified transverse cross-section of the structure of FIG. 1*a*.
Figure 1C:
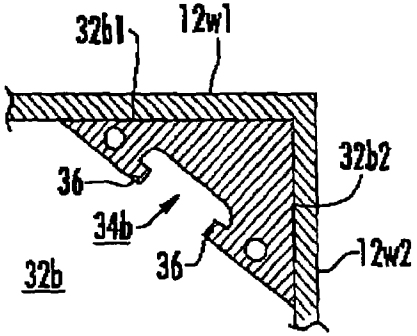
FIG. 1*c* is a detail of the structure of FIG. 1*b;*
Figures 2A, 2B, 2C:
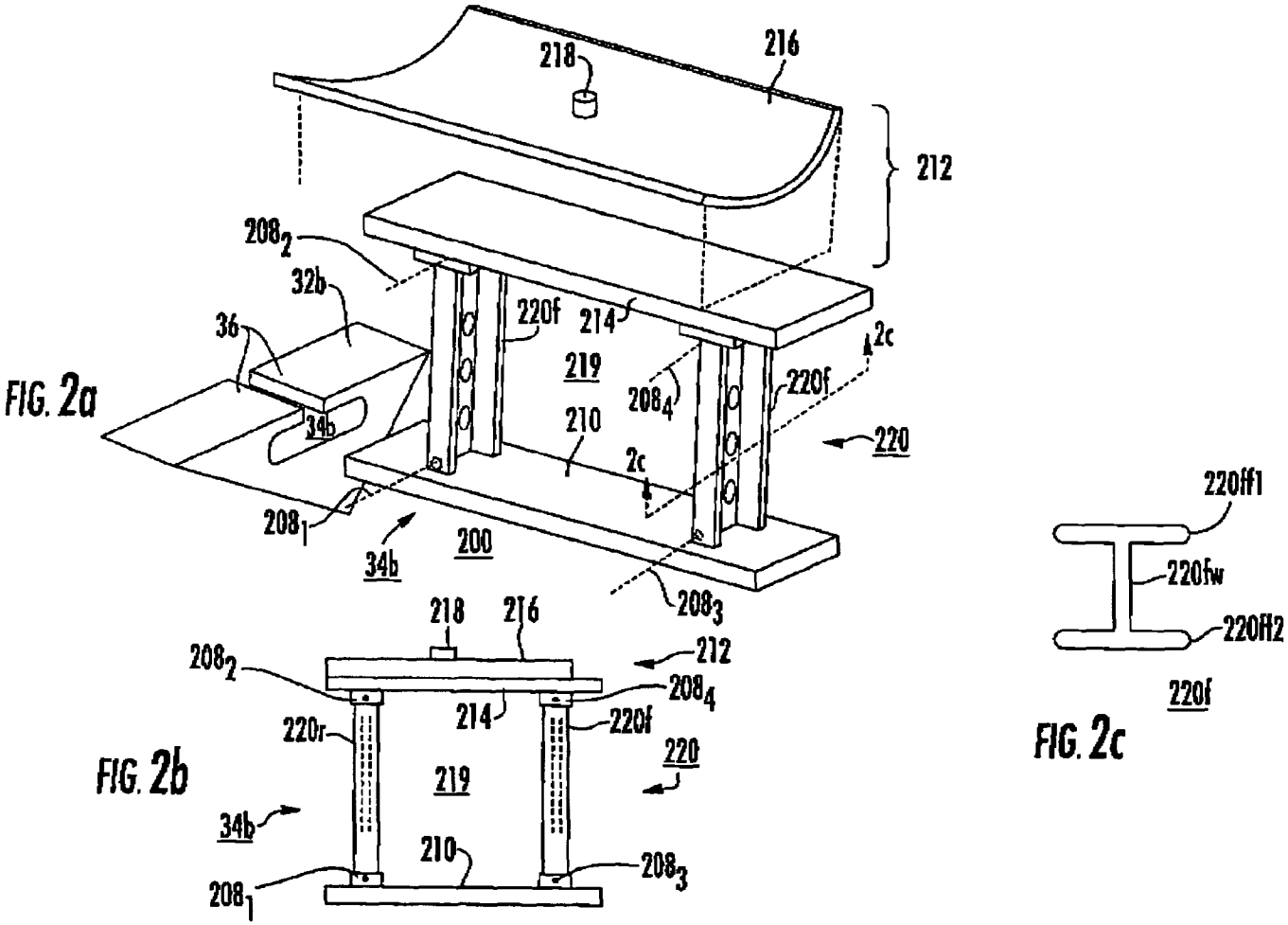
FIG. 2*a* is a simplified perspective or isometric view, partially exploded, of a railcar of FIG. 1*a*.
FIG. 2*b* is a side elevation of the structure of FIG. 2*a*.
FIG. 2*c* is a cross-section of an I-beam of FIG. 2*a;*
Figure 3A:
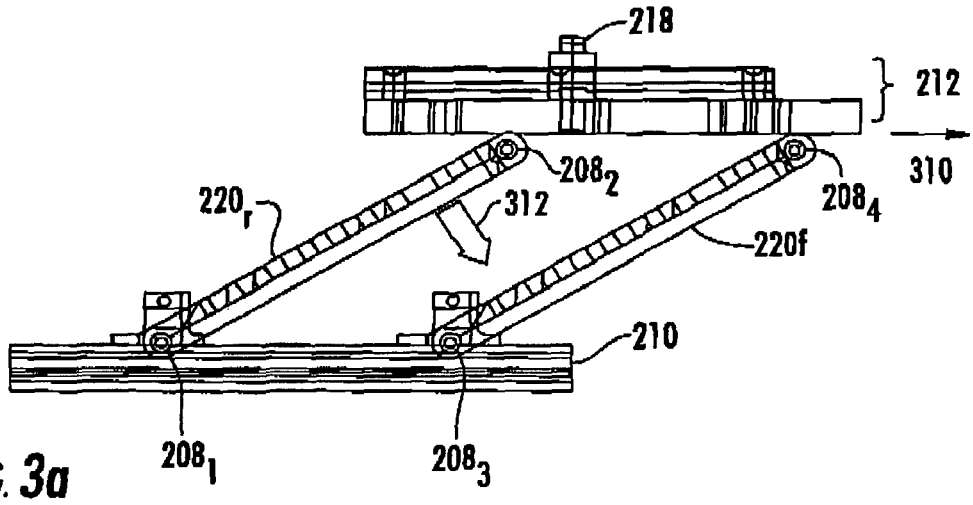
FIG. 3*a* is a side elevation view of the structure of FIG. 2*a* or 2*b* in a partially collapsed state, indicating direction of motion.
Figure 3B:
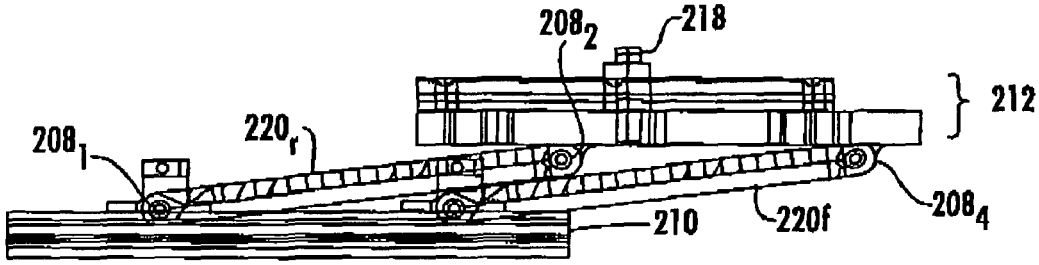
FIG. 3*b* is a corresponding view of the completely collapsed structure.
Figure 3C:
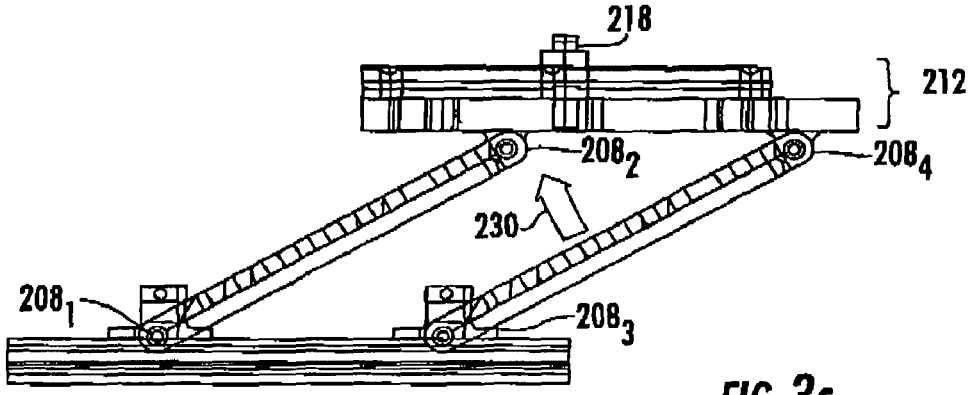
FIG. 3*c* illustrates the direction of motion of the structure of FIG. 3*a* during rebound.
Figure 3D:
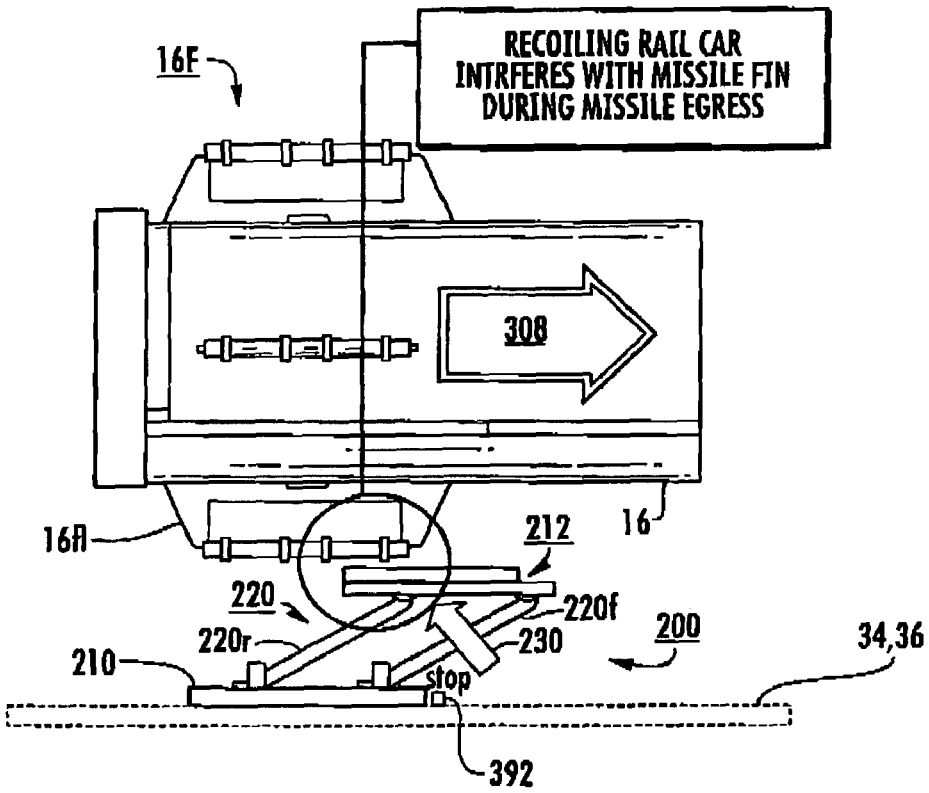
FIG. 3*d* illustrates the rebounding railcar support approaching a fin of a moving missile during launch, and also illustrates a rail stop.
Figure 4A:
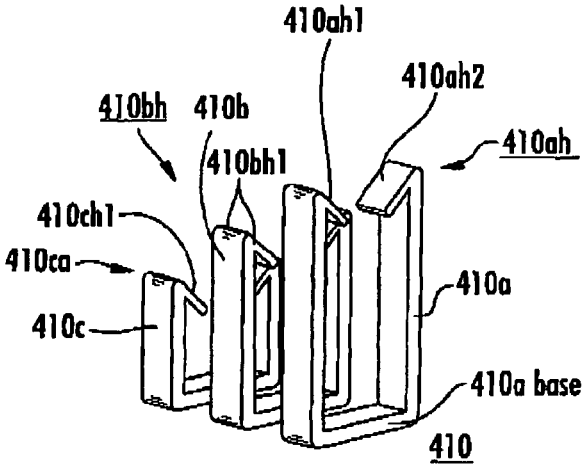
Figure 4B:
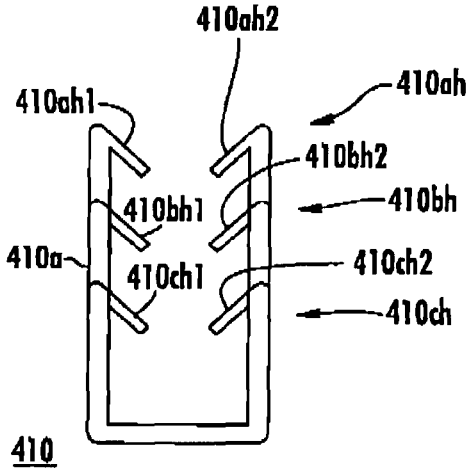
Figure 4C:
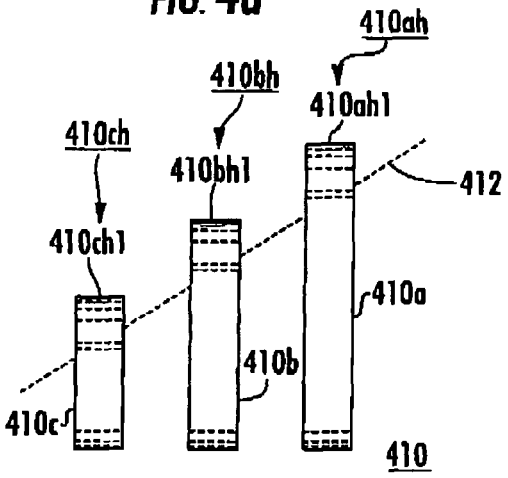
Figure 4D:
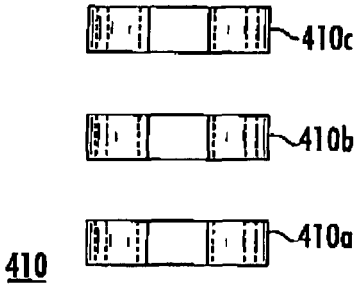
Figure 6A:
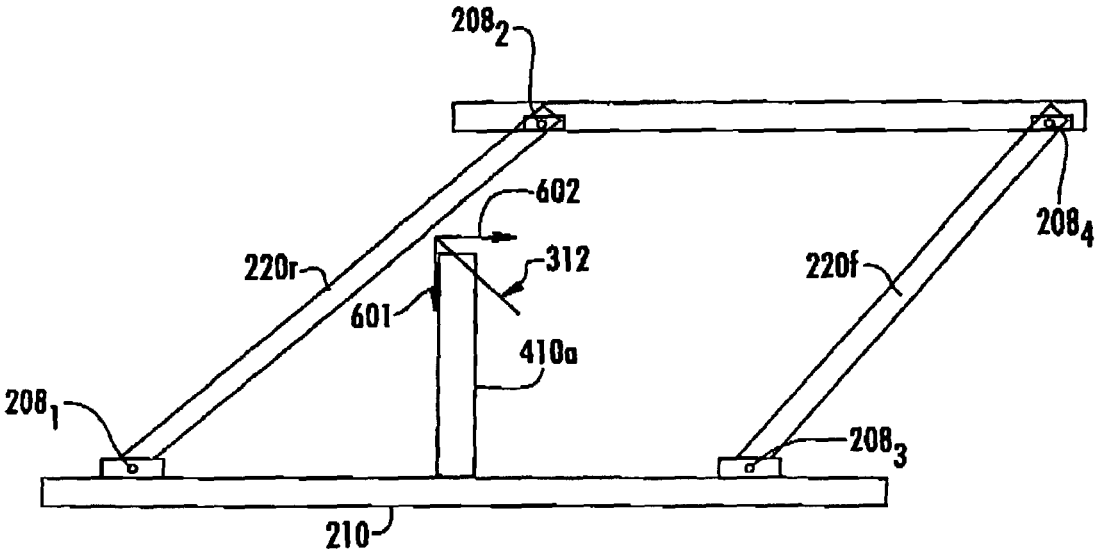
Figure 4E:
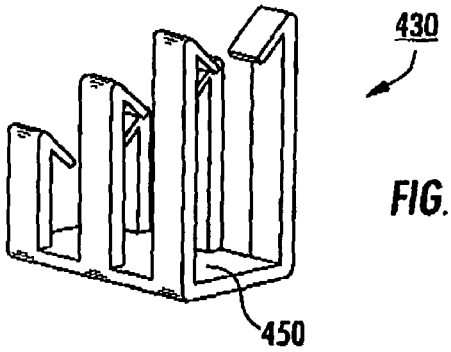
Figure 5A:
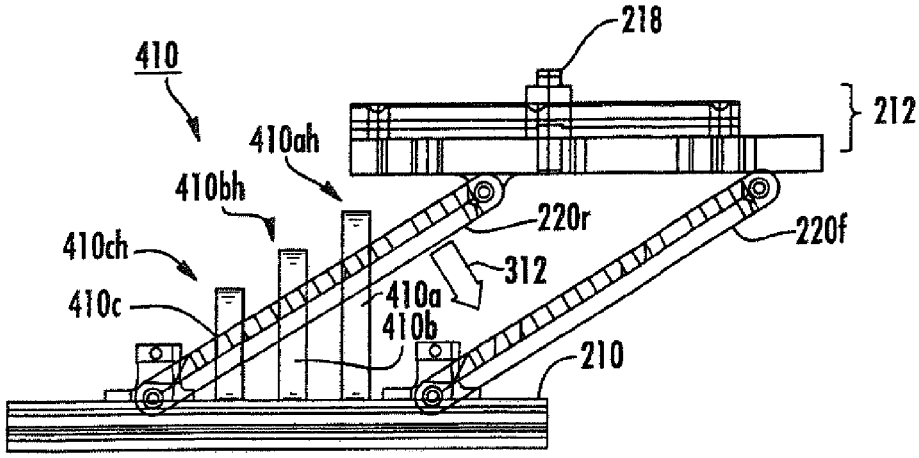
Figure 5B:
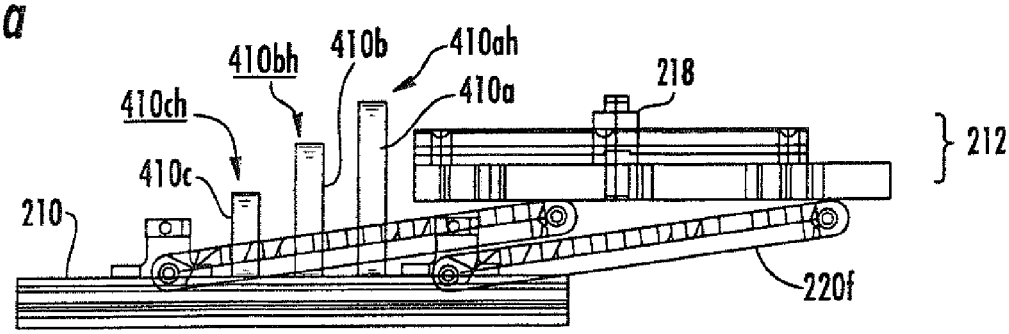
Figure 5C:
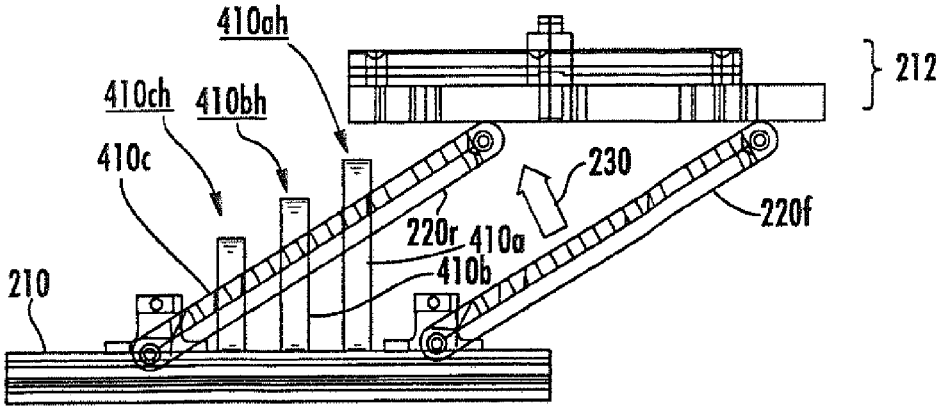
Figure 6B:
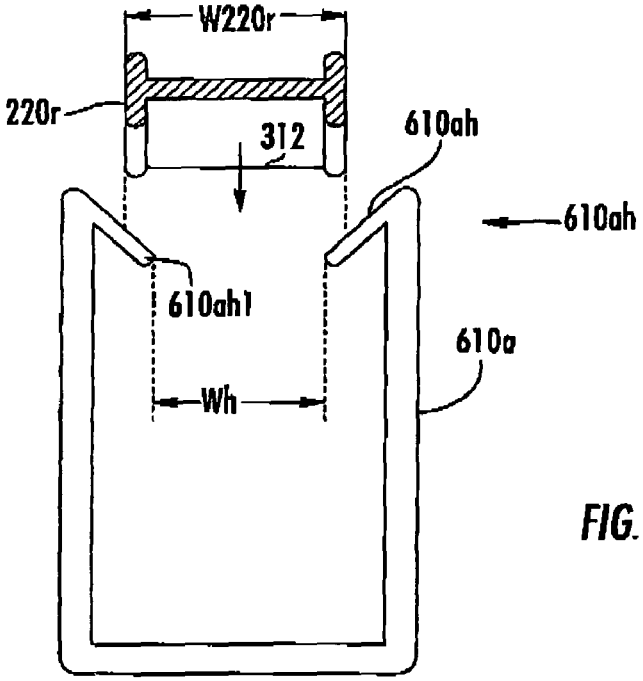
Figure 6C:
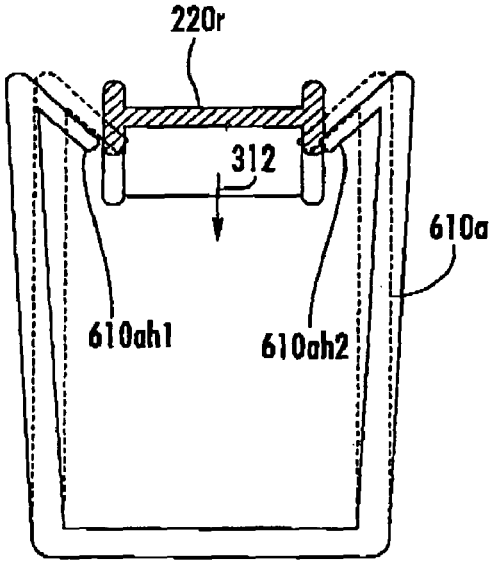
Figure 6D:
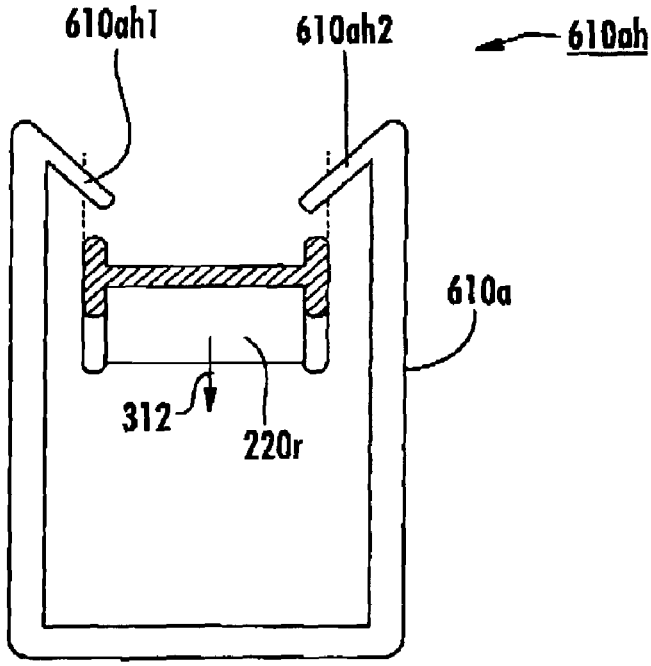
Figure 7A:
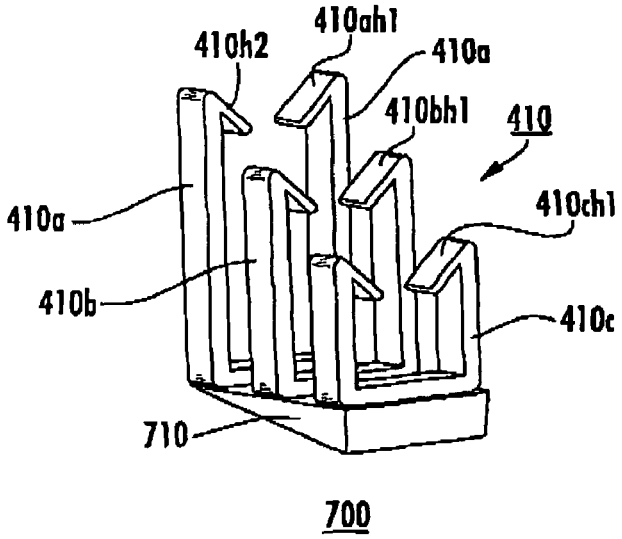
Figure 7B:
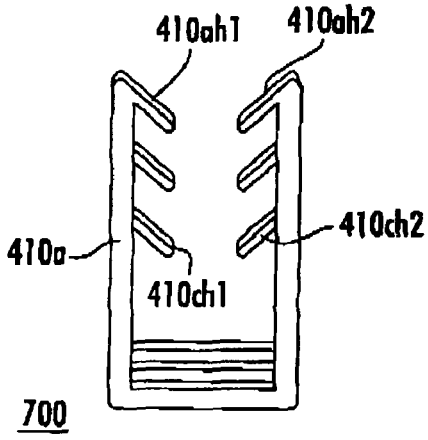
Figure 7C:
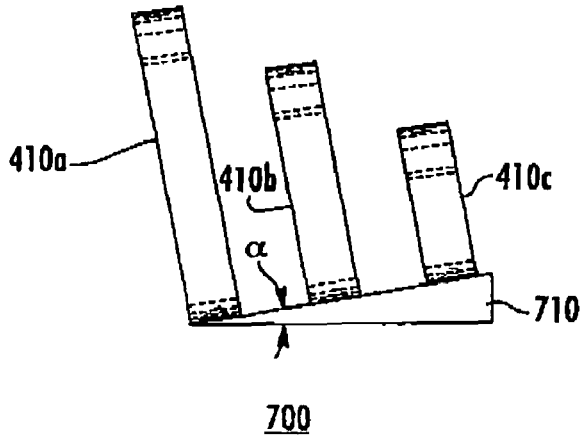
Figure 7D:
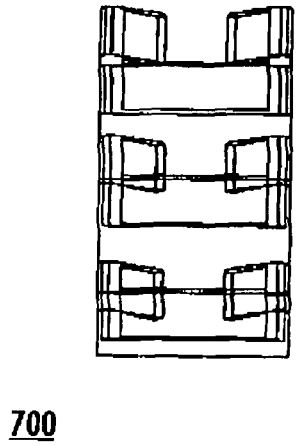
Figure 8A:
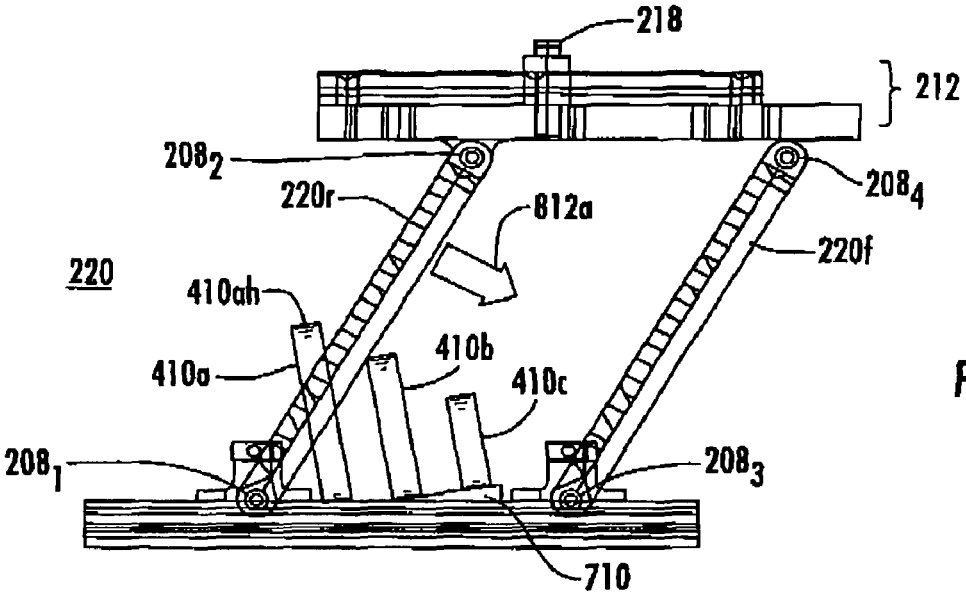
Figure 8B:
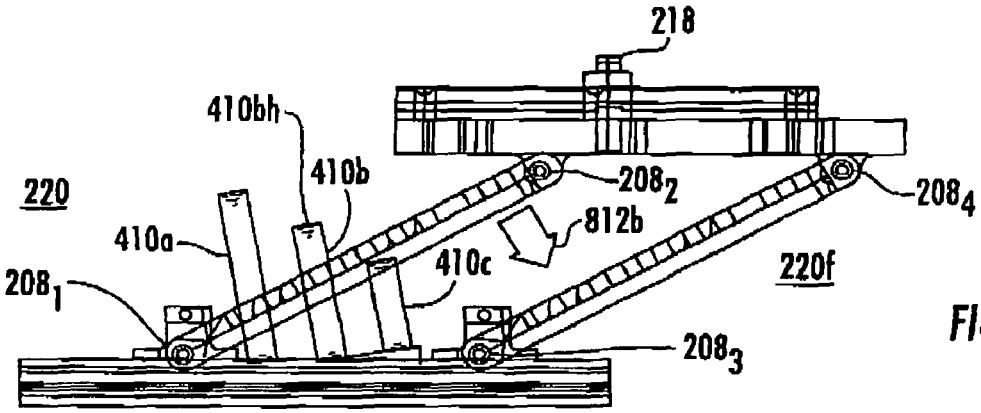
Figure 8C:
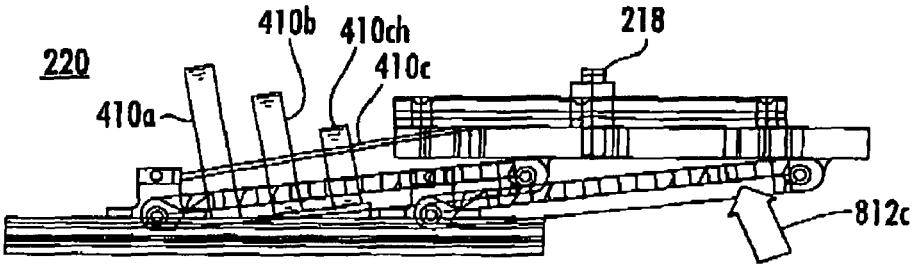
Figure 9:
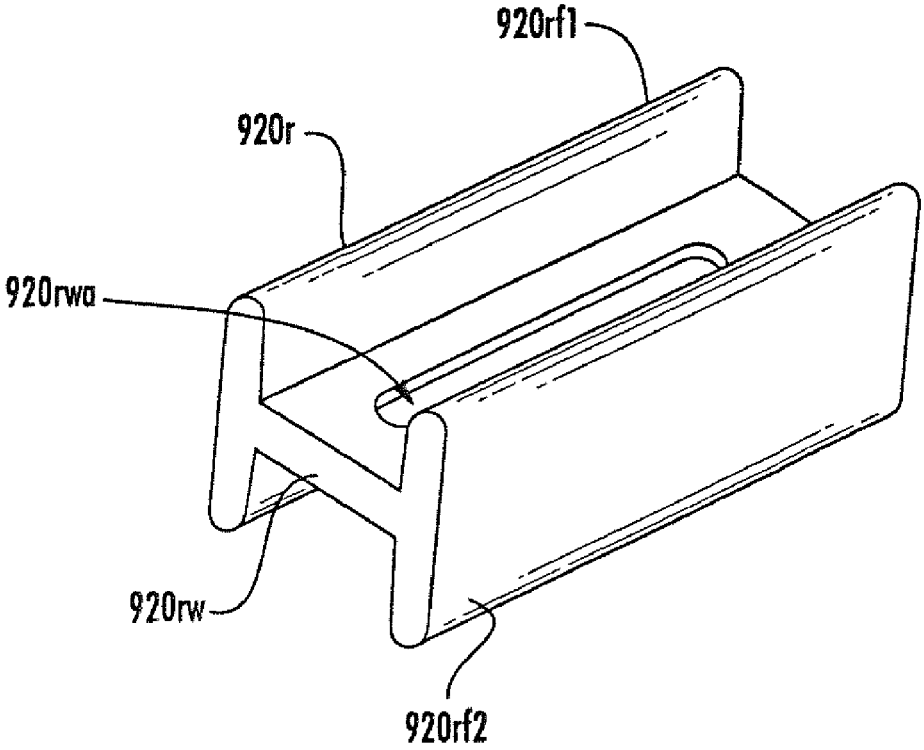

FIGS. 4*a*, 4*b*, 4*c*, and 4*d* are oblique, side elevation, front elevation, and top or plan views, respectively, of a set of three separate hooked or barbed clips according to an aspect of the invention, and FIG. 4*e* illustrates an alternative arrangement in which the three clips are joined by a common base;

FIGS. 5*a*, 5*b*, and 5*c* illustrate a set of three clips such as those of FIG. 4*a*, 4*b*, 4*c* or 4*d* affixed to the rail-engaging support structure of a railcar, showing the state of the railcar and its four-bar linkage immediately after linkage engagement with the clips, fully collapsed, and fully rebounded, respectively;

FIG. 6*a* is a simplified notional side elevation of a railcar with restraining clip, showing the forces applied to the clip at the time of engagement with a portion of a linkage, and FIGS. 6*b*, 6*c*, and 6*d* are side views of a single clip before engaging with an I-beam link, during engagement with an I-beam link, and after engagement with an I-beam link, respectively;

FIGS. 7*a*, 7*b*, 7*c*, and 7*d* are oblique, side, front, and top or plan views, respectively, of a set of clips similar to that of FIGS. 4*a*, 4*b*, 4*c*, and 4*d*, respectively, mounted on a wedge-shaped or tapered support;

FIGS. 8*a*, 8*b*, and 8*c* are front elevation views of a railcar fitted with clips such as those of FIGS. 7*a*, 7*b*, 7*c*, and 7*d*, at three different stages of clip engagement, namely linkage engagement with the longest clip, with the second clip, and with the shortest clip, respectively;

FIG. 9 is a perspective or isometric view of an I-beam type of element of a four-bar linkage, defining a web and an elongated aperture in the web, for use with anchors or clips such as those described in conjunction with FIGS. 10*a*, 10*b*, 10*c*, and 10*d;*

FIGS. 10*a*, 10*b*, 10*c*, and 10*d* are perspective, side, front, and top views, respectively, of another type of clip which can be used according to an aspect of the invention, FIGS. 10*e*, 10*f*, 10*g*, and 10*h* are elevation views that show steps in the engagement of the clips of FIGS. 10*a*, 10*b*, 10*c*, and 10*d* with the I-beam of FIG. 9, and FIGS. 10*i*, 10*j*, and 10*k* are perspective or isometric views showing steps generally corresponding to those of FIGS. 10*e*, 10*f*, 10*g*, and 10*h;*

Figure 11A:
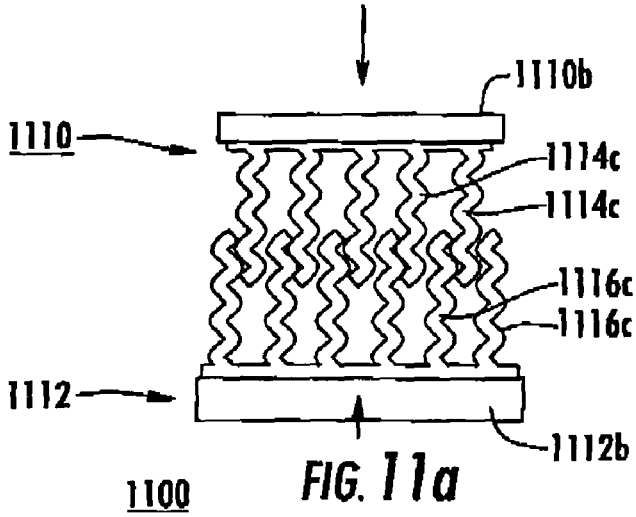
Figure 11B:
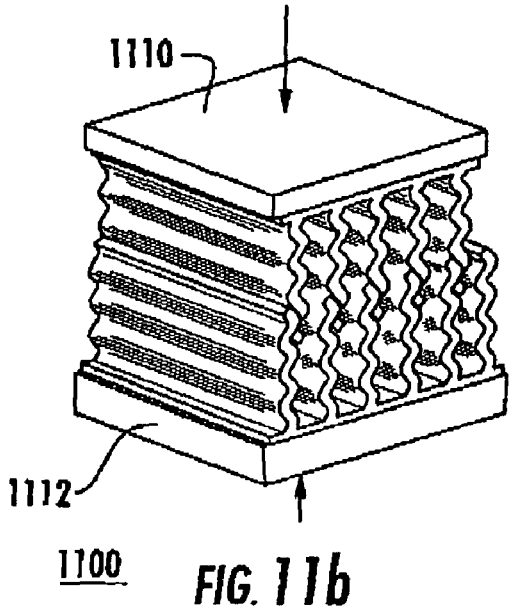
Figure 11C:
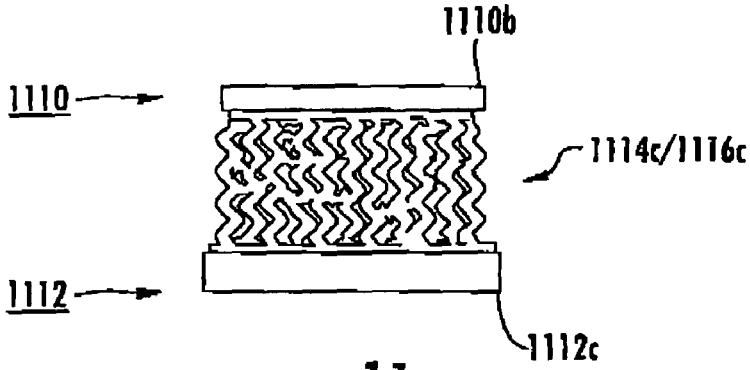
Figure 11D:
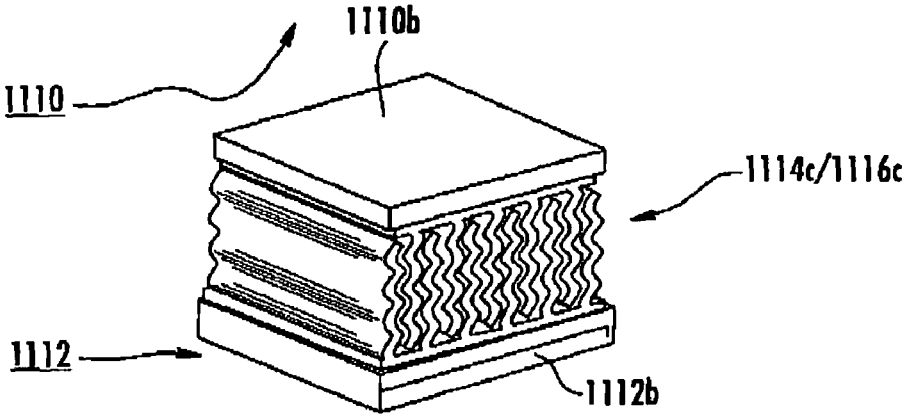
Figure 12A:
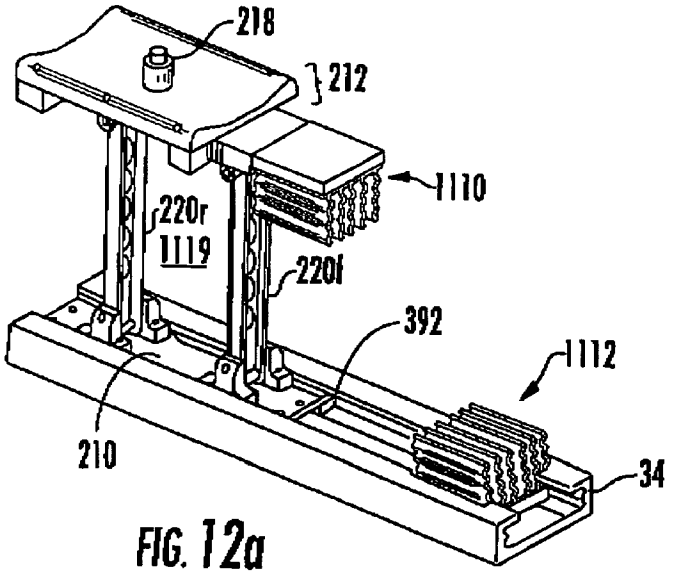
Figure 12B:
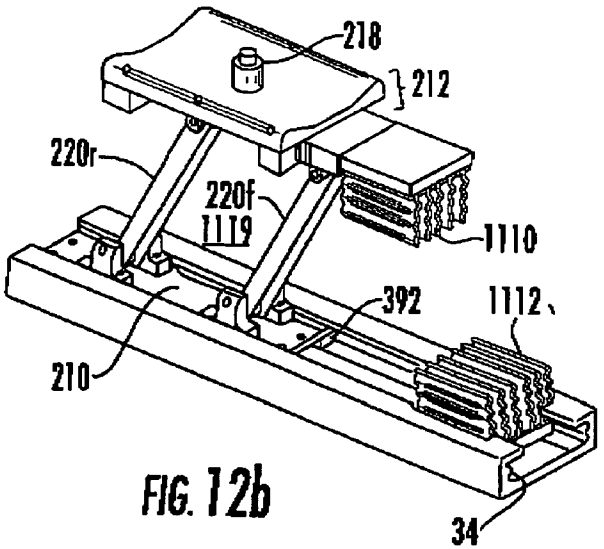
Figure 12C:
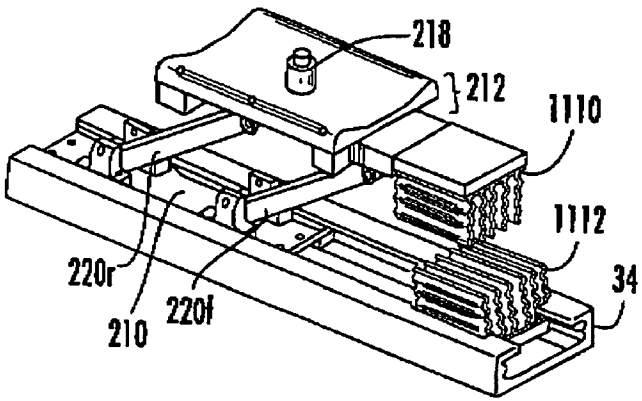
Figure 12D:
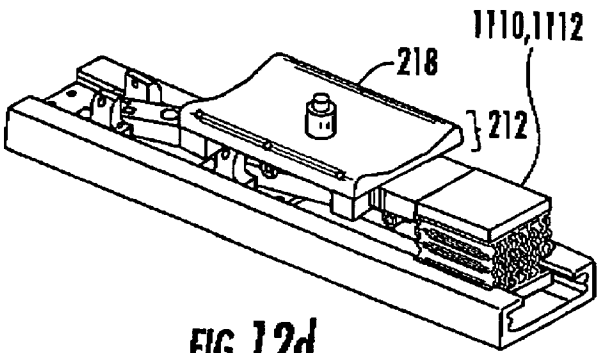
Figure 13:
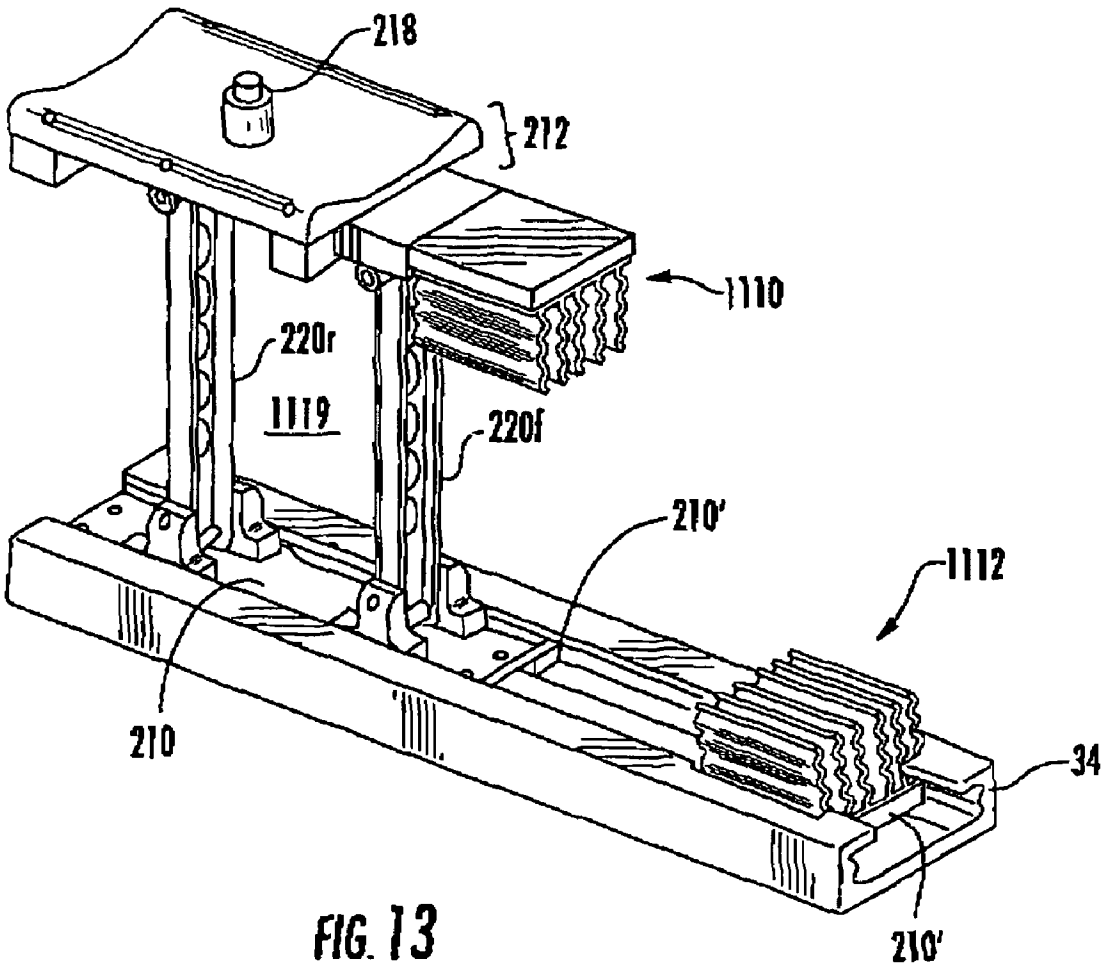

FIG. 11*a* is a front view of a first clip moving toward and beginning to engage with a second clip, FIG. 11*b* is an oblique view of the first and second clips at the start of engagement, FIG. 11*c* is a front view which illustrates the clips after engagement and permanent deformation, and FIG. 11*d* is an oblique view thereof;

FIGS. 12*a*, 12*b*, 12*c*, and 12*d* are perspective or isometric views of a railcar including rail-engaging support structure, missile-engaging guidance and/or support structure, and link elements or bars, and also including permanently deformable clips such as those illustrated in FIGS. 11*a*, 11*b*, 11*c*, and 11*d*, mounted on a portion of the railcar and on the rail, in initial, partial collapse, further collapse, and complete collapse, respectively; and FIG. 13 illustrates a railcar and rail in which a permanently deformable clip arrangement such as that of FIGS. 11*a*, 11*b*, 11*c*, and 11*d* is affixed to a portion of the railcar and to another portion of the railcar.

DESCRIPTION OF THE INVENTION

According to an aspect of the invention, one or more clips with hook-like distal ends are affixed to one of the support structures of the railcar, for engaging with at least a portion of the four-bar linkage to arrest the retrograde motion attributable to rebound or recoil. FIGS. 4*a*, 4*b*, 4*c*, and 4*d* are oblique, side elevation, front elevation, and top or plan views, respectively, of a set 410 of three such clips 410*a*, 410*b*, and 410*c*. Each clip 410*a*, 410*b*, and 410*c* includes a set 410*ah*, 410*bh*, and 410*ch*, respectively, of first and second hooks or barbs. The hooks or barbs of set 410*ah* are designated 410*ah*1 and 410*ah*2, the hooks or barbs of set 410*bh* are designated 410*bh*1 and 410*bh*2, and the hooks or barbs of set 410*ch* are designated 410*ch*1 and 410*ch*2. The spacing between the clips of set 410 is selected in conjunction with the dimensions of the four-bar linkage so that the linkage, when it enters one or more of the clips, is constrained against motion in the direction of arrow 230 in an amount that would allow contact between the fins and the missile-engaging support of the railcar. For this purpose, the clips are made from a strong, somewhat elastic material such as spring steel. In any case, the material must be elastic enough to allow the link to enter the clip, stiff enough to rebound prior to link kick-back or rebound, and strong enough to withstand the kick-back force. The heights of the clips of the set 410 are selected so that the hook or barb portions 410*ah*, 410*bh*, and 410*ch* lie along a straight line 412. FIG. 6*b* is a simplified illustration of a representative clip 610*a* including a set 610*ah* of hooks or barbs 610*ah*1 and 610*ah*2, with an I-beam linkage 220*r* (seen in cross-section) moving in direction 312 toward the hooks or barbs. As illustrated, the width $W_{220r}$ exceeds the distance or width $w_h$ between the tips of the hooks or barbs 610*ah*1 and 610*ah*2. FIG. 6*c* illustrates clip 610*a* with set 610*ah* of hooks or barbs, with an I-beam linkage 220*r* lying between the hooks or barbs. As illustrated, the tips of the hooks or barbs are deflected to encompass width $W_{220r}$ of the linkage 220*r*, and the main body portions of the clip 610*ah* are also somewhat deflected outwardly. FIG. 6*d* illustrates clip 610*a* with the I-beam linkage 220*r* moved past the hooks or barbs of set 610*ah*, and with the positions of the hooks or barbs of set 610*ah* restored to the positions they originally had in FIG. 6*b*.

FIG. 4*e* illustrates a set 430 of clips similar to set 410, but in which the clips of the set are joined by a common base 450, rather than being separate elements. The common base can be monolithic (also known as "integral") or assembled.

FIGS. 5*a*, 5*b*, and 5*c* illustrate the set 410 of three clips affixed to the rail-engaging support structure 210 of a railcar, with the hook or barb ends distal from the support. As illustrated in FIG. 5*a*, the rear I-beam 220*r*, collapsing in the direction of arrow 312, has passed the hook or barb region of each of the three clips 410*a*, 410*b*, and 410*c*. Due to the unequal heights of the clips of set 410, all of the hooks or barbs of the set 410 engage the slanted rear I-beam 220*r* substantially simultaneously. Inertia and possibly spring loading cause the collapsing railcar to completely collapse, as illustrated in FIG. 5*b*. As mentioned, the elasticity of the materials is such that the missile-engaging support 212 and the four-bar linkage recoil in the direction of arrow 230, as illustrated in FIG. 5*c*. With the clip set in place, the missile-engaging support structure 212 can only recoil until the hooks of the clips engage the I-beam 220*r* in a position short of full recoil, such as that position illustrated in FIG. 5*c*. The position of maximum recoil can be selected by selection of the lengths of the clips and the positions of the hook or barb portions along the lengths of the clips. This position is selected to prevent unwanted contact between the any portion of the railcar and the missile, including its fins.

When the rear four-bar linkage or I-beam 220*r* of FIG. 5*a* initially engages the clips, the forces applied to the ends of the clips are not in line with the elongated main bodies of the clips. FIG. 6*a* illustrates a clip 410*a* oriented relative to I-beam 220*r* a moment before the hook of the clip 410*a* begins to engage the I-beam. As illustrated in FIG. 6*a*, the direction of motion 312 can be resolved into two components, namely parallel component 610 and orthogonal component 602. The forces acting upon the clip can similarly be resolved into parallel and orthogonal components. The parallel component is resisted by the compressive strength of the clip, but the orthogonal component may tend to cause bending. The tendency to bend can be corrected by making the clip thicker, but this tends to increase the mass and cost.

According to an aspect of the invention, the clips are mounted at an angle so that the compressive strength of the clips directly resists the engagement forces. FIGS. 7*a*, 7*b*, 7*c*, and 7*d* are oblique, side, front, and top or plan views, respectively, of a set of clips similar to that of FIGS. 4*a*, 4*b*, 4*c*, and 4*d*, respectively, mounted on a wedge-shaped or tapered support 710. The included angle α of support 710 is selected so that the forces applied to the clips by the four-bar linkage during engagement with the hooks is generally parallel with the direction of elongation of the clips, so there is little or no bending moment. As with the clips described in conjunction with FIGS. 4*a*, 4*b*, 4*c*, and 4*d*, the clips of FIGS. 7*a*, 7*b*, 7*c*, and 7*d* may be made integral or monolithic with the tapered support 710.

FIGS. 8*a*, 8*b*, and 8*c* are front elevation views of a railcar fitted with clips such as those of FIGS. 7*a*, 7*b*, 7*c*, and 7*d*, at three different stages of clip engagement. FIG. 8*a* represents a state of the pantograph-like linkage 220 in which the movement of the rear four-bar linkage or I-beam 220*r* has progressed in the direction of arrow 812*a* past the hook of clip 410*a*. As the linkage 220*r* passes the hook 410*ah* of clip 410*a*, both the hook and the clip deflect. When the linkage 220*r* is past the hook 410*ah* of clip 410*a*, the elasticity of the hook and clip restore its or their position, to thereby engage the clip. At the position illustrated in FIG. 8*a*, the rear four-bar linkage or I-beam 220*r* has not progressed sufficiently to engage remaining clips 410*b* or 410*c*. FIG. 8*b* represents a state in which the movement of the rear four-bar linkage or I-beam 220*r* has progressed in the direction of arrow 812*b* past the hook 410*bh* of clip 410*b*, deflecting them, so that the elasticity of the hook and of the clip 410*b* can restore its relaxed position to thereby engage the clip with the linkage 220*r*. FIG. 8*c* represents the full collapse of the railcar 220, so that rear four-bar linkage or I-beam 220*r* has progressed in the direction of arrow 812*a* or 812*b* past the hook 410*ch* of clip 410*c*. As the linkage 220*r* passes the hook 410*ch* of clip 410*c*, both the hook and the clip deflect. When the linkage 220*r* is past the hook of clip 410*c*, the elasticity of the hook and clip can restore its or their relaxed position, to thereby engage the clip with the linkage 220*r*. At the position illustrated in FIG. 8*c*, the rear four-bar linkage or I-beam 220*r* has been engaged by all three clips 410*a*, 410*b*, and 410*c*. Rebound or recoil in the direction of arrow causes rear linkage 220*r* to move upward, to be stopped or at least slowed by the shortest clip 410*c*. If clip 410*c* holds, the recoil stops in substantially the position illustrated in FIG. 8*c*. Should the shortest clip 410*c* fail to hold, some of the recoil energy is dissipated, so that the next clip, namely clip 410*b*, can further retard or stop the recoiling structure. The longest clip 410*a* acts in the same manner should clip 410*b* fail to stop the recoil. By comparison with the simultaneous engagement of the arrangement of FIGS. 5*a*, 5*b*, and 5*c*, the clips of FIGS. 8*a*, 8*b*, and 8*c* engage sequentially.

Figure 10A:
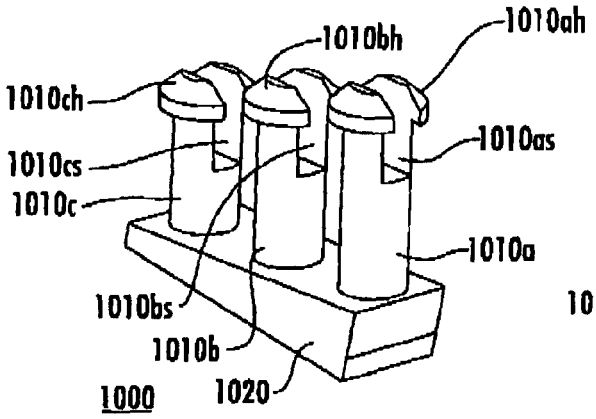
Figure 10B:
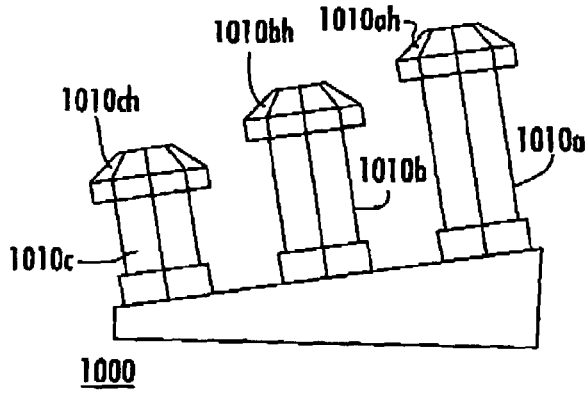
Figure 10C:
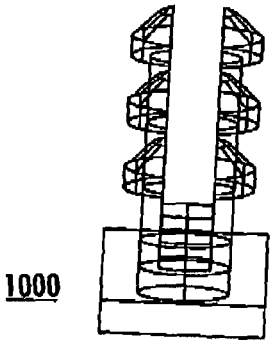
Figure 10D:
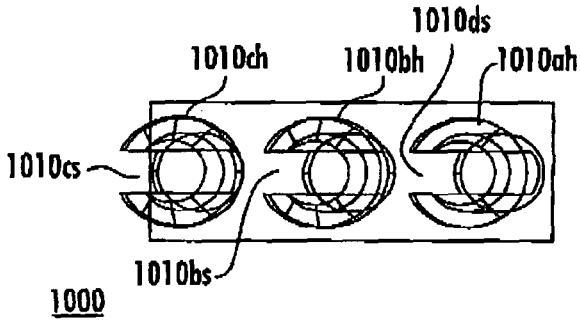
Figure 10F:
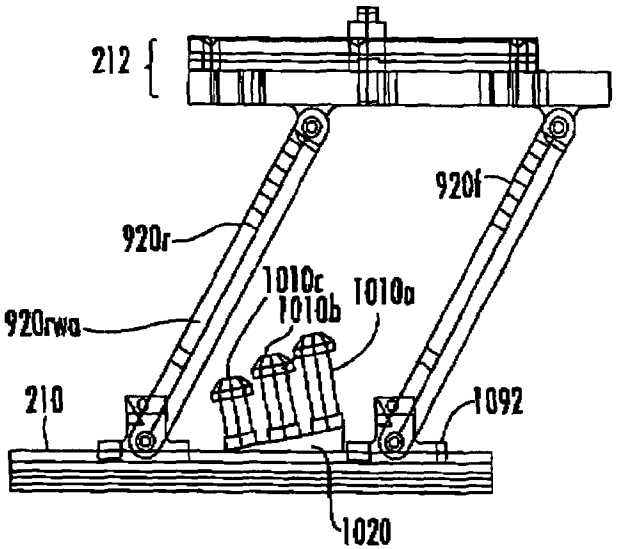
Figure 10E:
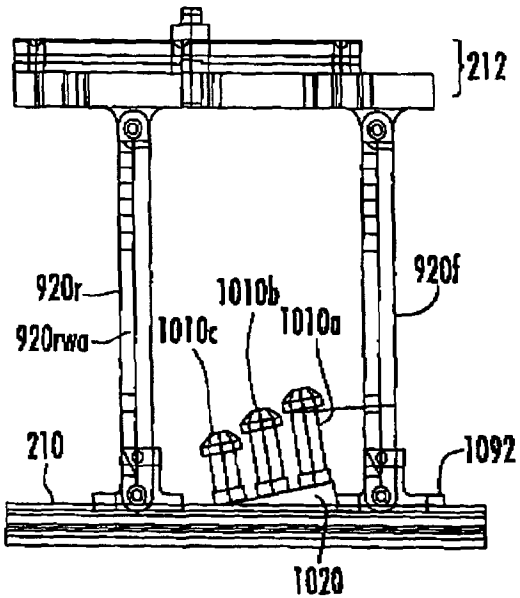
Figure 10H:
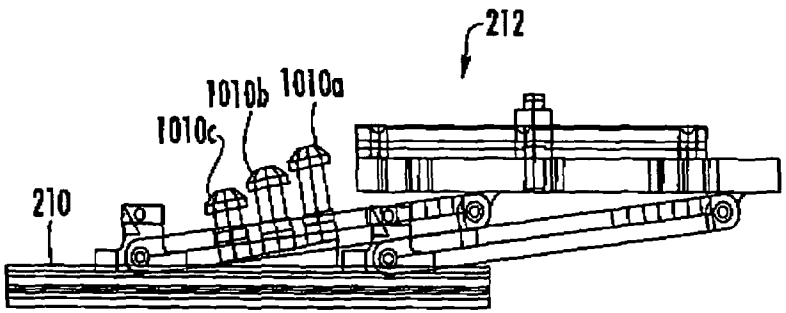
Figure 10G:
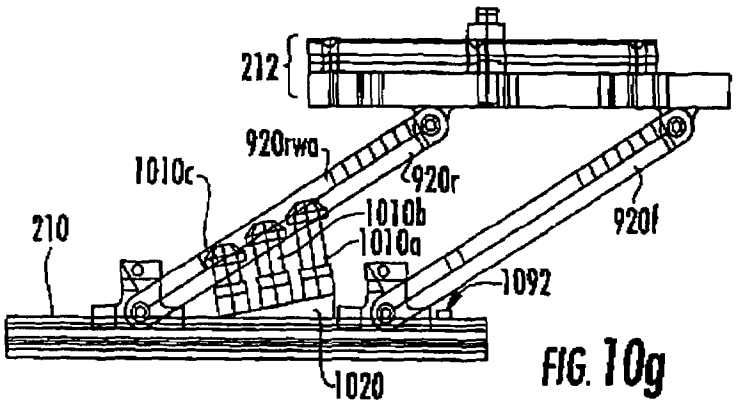
Figure 10J:
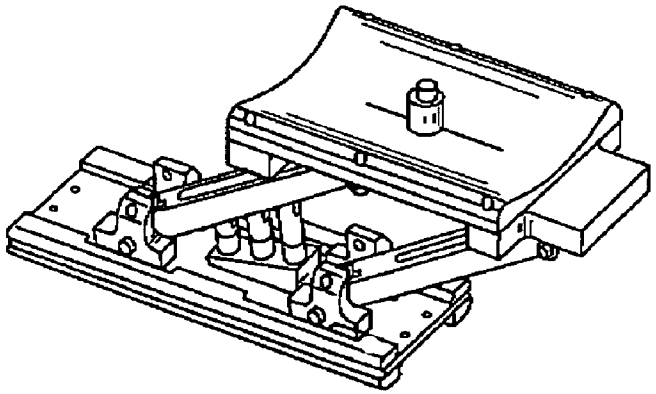
Figure 10I:
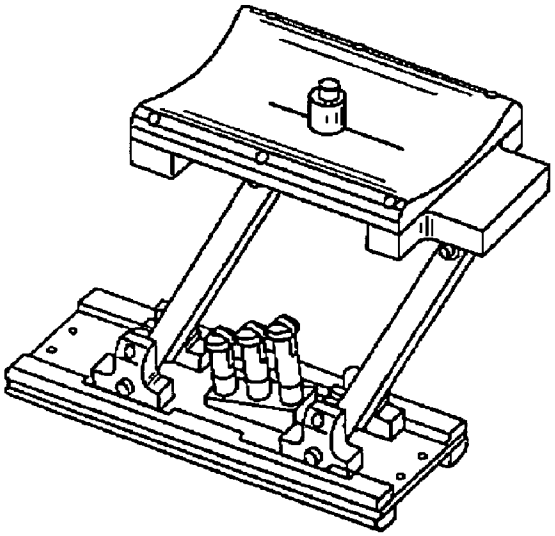
Figure 10K:
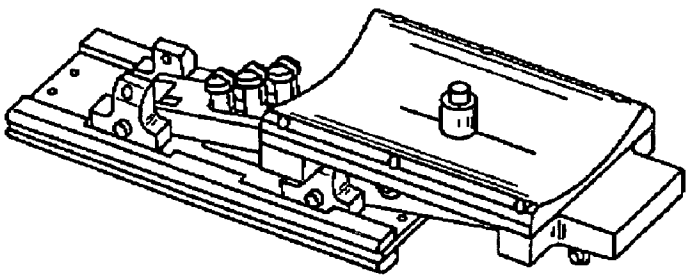

Rather than having the clips engaging the outer edges of the four-bar linkage, the clips can engage with one or more locations within the linkage. FIG. 9 is a simplified representation of a rear I-beam linkage 920*r* defining first and second flanges 920*rf*1 and 920*rf*2, respectively, and a web 920*rw*. The web 920*rw* defines an elongated through aperture or slot 920*rwa*. This aperture can be used to engage clips (sometimes known as "anchors") for capturing the linkage much as with the clips of FIGS. 4*a*, 4*b*, 4*c*, 4*d*, 5*a*, 5*b*, and 5*c*. FIGS. 10*a*, 10*b*, 10*c*, and 10*d* illustrate a set 1010 of three anchor clips 1010*a*, 1010*b*, and 1010*c*, each in the form of a split pin with a bulbous head. In FIGS. 10*a*, 10*b*, 10*c*, and 10*d* pin 1010*a* defines a bulbous head 1010*ah* and a slot 1010 as, which slot extends through a portion of the pin and through the bulbous head, pin 1010*b* defines a bulbous head 1010*bh* and a slot 1010*bs*, and pin 1010*ca* defines a bulbous head 1010*ch* and a slot 1010*cs*. Pins 1010*a*, 1010*b*, and 1010*c* are mounted on a tapered or ramped support 1020. FIGS. 10*e*, 10*f*, 10*g*, and 10*h* are side elevation views illustrating how a slotted linkage such as that of FIG. 9 can approach and engage the slotted pin clips of FIGS. 10*a*, 10*b*, 10*c*, and 10*d* when the rail-engaging support 210 ceases travel to the right when it hits stop 1092. FIGS. 10*i*, 10*j*, and 10*k* are perspective or isometric views corresponding to positions illustrated in FIGS. 10*e*, 10*f*, 10*g*, and 10*h*.

As so far described, the linkage-restraining clips deform during engagement, and then revert to their original forms to capture the moving linkage or support. According to another aspect of the invention, the clip or clips can be arranged to permanently deform in response to the engaging force. The permanent deformation absorbs energy during the engagement and deformation, so that less energy is available for recoil. Additionally, the deformed clip(s) can also capture the linkage or moving platform. FIG. 11*a* is a front view of a first clip 1110 moving toward and beginning to engage with a second clip 1112. The first or second clip may be fixed, or both may move, so long as there is relative motion toward each other. As illustrated, some of the corrugated engaging elements associated with clip 1110 are designated 1114*c*. The corrugated elements 1114*c* are all affixed at a proximal end to a clip base element 1110*b*, and have their distal ends spaced apart by approximately the width of one corrugated element. Similarly, some of the corrugated engaging elements associated with clip 1112 are designated 1116*c*. The corrugated elements 1116*c* are all affixed at a proximal end to a clip base element 1112*b*, and have their distal ends spaced apart by approximately the width of one corrugated element. FIG. 11*b* is an oblique view of clips 1110 and 1112 at the start of engagement. FIG. 11*c* is a front view which illustrates the clips 1110 and 1112 after engagement. As illustrated, the corrugated elements are physically deformed to form a mass designated 1114*c*/1116*c*. FIG. 11*d* is an oblique view of the conjoined clips of FIG. 11*c*. The deformation of the corrugated elements of the clips absorbs energy, and can be used to reduce or even absorb all of the recoil energy. Also, the deformation tends to lock the two separate portions together so as to provide restraint against retrograde motion similar to that provided by the clips 410 or 1000.

FIGS. 12*a*, 12*b*, 12*c*, and 12*d* are perspective or isometric views of a railcar including rail-engaging support 210, missile-engaging support structure 212, and link elements or bars 220*r*, 220*f*, each element or bar being in the form of an I-beam. The link elements or bars of FIGS. 12*a*, 12*b*, 12*c*, and 12*d* are hinged to the rail-engaging support 210 and to missile-engaging support 212 much as described in conjunction with FIGS. 2*a*, 2*b*, 2*c*, 3*a*, 3*b*, and 3*c*. The arrangement of FIGS. 12*a*, 12*b*, 12*c* and 12*d* differs in that it includes an energy-absorbing clip arrangement such as that described in conjunction with FIGS. 11*a*, 11*b*, 11*c*, and 11*d*. More particularly, in FIGS. 12*a*, 12*b*, 12*c*, and 12*d* one clip element, such as clip element 1110, is affixed to the missile-engaging support 212, and the other clip element 1112 is affixed to the rail at a location downstream (in the direction of missile motion) from railcar stop element 392. Clip element 1112 is affixed to the rail 34 at a location downstream (in the direction of missile motion and overall railcar motion) from the rail stop 392, because the motion of the missile-engaging support 12 during collapse brings the leading edge forward of the rail-engaging support 210. In operation of the arrangement of FIGS. 12*a*, 12*b*, 12*c*, and 12*d*, the railcar traveling to the right reaches rail stop 392, and the rail-engaging support ceases its forward motion. At the same time, a latch associated with the rail stop 392 unlocks the locked hinge(s) of the four-bar linkage 1119. This state is illustrated in FIG. 12*a*. The inertia of the structure causes the missile-engaging structure 12 to continue to move to the right, and the four-bar linkage 1119 begins to collapse, as illustrated in FIG. 12*b*. A moment later, the collapse continues, as illustrated in FIG. 12*c*. Finally, the collapse is complete, and the energy-absorbing clips 1110 and 1112 engage and deform, as described in conjunction with FIGS. 11*a*, 11*b*, 11*c*, and 11*d*. The deformation absorbs energy from the collapsing structure, and also tends to prevent rebound.

FIG. 13 is a simplified perspective or isometric view of another embodiment of the invention, which uses the deformable clips of FIGS. 11*a*, 11*b*, 11*c*, and 11*d*. In FIG. 13, the uppermost clip element 1110 is affixed to the forward or leading edge of missile-engaging structure 12, as in FIGS. 12*a*, 12*b*, 12*c*, and 12*d*. The lower clip element 1112, however, is not mounted on the rail 34, but instead is mounted on a forward extension 210' of the rail-engaging support 210. In this embodiment, the clip portions engage each other and permanently deform to absorb energy and to lock the rail engaging support 210 (and 210') to the missile-engaging support 12.

A collapsible structure (200) according to an aspect of the invention is for controllably supporting a load (16). The collapsible structure (200) comprises underlying support structure (210), a load bearing support structure (212), and a collapsible support arrangement (220) extending between the underlying support structure (210) and the load bearing support structure (212). The collapsible support arrangement (220) is hingedly (208) affixed to the underlying support structure (210) and to the load bearing support structure (212), and together therewith defines a four-bar linkage (219) for supporting the load bearing support structure (212) in a position generally parallel with the underlying support structure (210) when a hinge of the four-bar linkage is locked, and for allowing collapsing motion of the load bearing support structure (212) relative to the underlying support structure (210) when the hinge is unlocked. According to an aspect of the invention, a capture arrangement (1100) is affixed to at least one of (a) the underlying support structure (210) and (b) the load bearing support structure (212), for permanently deforming in conjunction with the collapse of the four-bar linkage (219) so as to absorb energy from the collapse of the load bearing support structure (212) toward the underlying support structure (210) and to thereby tend to reduce rebound. In a particular embodiment of this aspect, the collapsible structure (200) is part of a railcar (200) in which the underlying support structure (210) is for engaging and traveling along a rail (34).

According to another aspect of the invention, a missile launch arrangement (10) comprises an elongated missile (16) defining a front ($\mathbf{16}_{front}$) and a rear (16*r*), and also defining a generally cylindrical body (16*b*) extending between the front ($\mathbf{16}_{front}$) and the rear (16*r*). The body (16*b*) of the missile (16) supports outboard structures (16F) which extend outwardly from the cylindrical body (16*b*). An elongated canister (12) defines (a) an axis (8), (b) an elongated storage region (14) about the axis (8), and (c) a missile exit or egress end (12*me*). The elongated storage region (14) is dimensioned to accommodate the generally cylindrical body (16*b*) of the missile (16) and its outboard structures (16F). A plurality of collapsible cars (20*a*, 20*b*) is provided, each of which includes a car support structure (210), a missile support structure (212), and a collapsible intermediary support (220) lying between the car support structure (210) and the missile support structure (212), for holding the car support structure (210) away from the missile support structure (212) in a first mode of operation (locked), and for allowing the missile support structure (212) to approach the car support structure (210) in a second mode of operation (unlocked). Each of the collapsible cars lies between at least one wall (12*w*) of the storage region (14) and the cylindrical body (16*b*) of the missile (16), with the car support structure (210) adjacent the at least one wall (12*w*) of the storage region (14). The cars (200), acting together in the first mode of operation (locked), support the body (16*b*) of the missile (16) generally centered about the axis (8) in the storage region (14). This support extends to or includes the time at which the missile (16) travels toward the egress end (12*me*) of the canister (12). Each of the intermediary supports (220) of the collapsible cars (200) is arranged for collapsing in conjunction with a transition between the first mode of operation (locked) and the second mode of operation (unlocked) when the associated car (200) reaches a particular travel position (stop) along the storage region (14) of the canister (12). Capture means (410; 700; 1000; 1100) are provided. The capture means (410; 700; 1000; 1100) are one of (a) affixed to one of (i) the car support structure (210) and (ii) the missile support structure (212), for capturing the intermediary support (220) during or after the transition, thereby tending to prevent substantial rebounding motion of the intermediate support (220) and the missile support structure (212) toward the missile body (16*b*), and (b) affixed to the at least one wall (12*w*) of the storage region (14) and to the missile support structure (212), for mutual capture in association with or during the transition, thereby tending to reduce rebounding motion of the missile support structure (212) toward the missile body (16*b*). In one embodiment of this aspect of the invention, the capture means (410; 700; 1000; 1100) comprise mutually mating elements (1110, 1112) which permanently deform during mating to thereby absorb energy and establish permanent capture. In another embodiment the capture means comprise hooked elements (410; 700; 1000) for capturing a portion of the intermediate support (220).

Thus, a missile (16) is guided and/or supported, according to an aspect of the invention, within a canister (12) by at least one collapsible guidance and/or support structure (219). In one embodiment the collapsible structure (219) is part of a railcar (200) running on a rail (34) within the canister (12). Each railcar (200) includes a missile guide or support (212), a rail engaging element (210), and a hinged pantograph-like collapsible support (220) extending between the missile engaging guide and/or support (212) and the rail engaging element (210). A hinge (208) of the pantograph (220) is locked in a storage state and during part of motion during the missile launch. The hinge is unlocked, and travel of the rail engaging element is stopped essentially simultaneously. The missile guide or support (212) momentarily continues its motion, and the pantograph (220) collapses. Capture elements (410; 1010; 1100) engage parts of the railcar (200) or the canister (12) during collapse to prevent rebound of the missile guide and/or support toward the missile (16).

A collapsible structure according to an aspect of the invention, as for a railcar (200) for engaging and traveling along a rail (34), comprises an underlying support, as for example in the form of a rail engaging structure (210), and also comprises and a load guidance and/or support structure (212). A collapsible support arrangement (220) extends between the underlying support or rail engaging structure (210) and the load guidance and/or support structure (212). The collapsible support arrangement (220) includes a four-bar linkage (220*r*, 220*f*) hingedly affixed to the underlying support or rail engaging structure (210) and to the load guidance and/or support structure (212), for supporting the load guidance and/or support structure (220) in a position generally parallel with the underlying support or rail engaging means (210) when a hinge of the four-bar linkage (220*r*, 220*f*) is locked, and for, when motion of the rail car along the rail is interrupted, allowing the load guidance and/or support structure to maintain a component of the motion and to collapse toward the underlying support or rail engaging portion (210). A capture arrangement (410; 430; 700; 1000; 1100) is affixed to at least one of the underlying support structure and the load guidance and/or support structure, for elastically deforming in conjunction with the collapse of the four-bar linkage so as to capture the four-bar linkage and prevent rebounding motion of the four-bar linkage or the load guidance and/or support structure. In a particular embodiment, the collapsible structure is part of a railcar in which the underlying support structure is for engaging and traveling along a rail.

A missile launch arrangement (10) according to an aspect of the invention comprises an elongated missile (16). The missile defines a front ($\mathbf{16}_{front}$) and a rear (16*r*), and also defines a generally cylindrical body (16*b*) generally about a longitudinal axis (8) and extending between the front ($\mathbf{16}_{front}$) and the rear (16*r*). The body (16*b*) of the missile (16) supports outboard structures (16F) which extend outwardly from the cylindrical body (16*b*). In one embodiment, the outboard structures include folded fins. The missile launch arrangement (10) also includes an elongated canister (12) including at least one wall (12*w*) defining (a) an elongated storage region (14) about the longitudinal axis (8) between a missile egress end (12*me*) and a back end (12*be*). The elongated storage region (14) is dimensioned to accommodate the generally cylindrical body (16*b*) of the missile (16) and its outboard structures (16F). A plurality of collapsible rail cars (200) is provided. Each of the collapsible rail cars (200) includes a rail-engaging structure (210), a missile guidance and/or support structure (212), and a collapsible intermediary support (220) lying between the rail engaging structure (210) and the missile guidance and/or support structure (212). The intermediary support (220) may be in the genera) form of a pantograph. The collapsible intermediary support (220) is for holding the rail engaging structure (210) away from the missile guidance and/or support structure (212) in the storage state, and for allowing the missile guidance and/or support structure (212) to approach the rail engaging structure (210) in a second state (during the transition to missile launch). Each of the collapsible rail cars (200) lies between at least one wall (12*w*) of the storage region (14) and the cylindrical body (16*b*) of the missile (16), with the rail engaging structure (210) adjacent the at least one wall (12*w*) of the storage region (14). The rail cars (200), acting together in the storage state, guide and/or support the body (12*w*) of the missile (12) generally centered about the axis (8) in the storage region (14) as the missile (16) travels toward the egress end (12*me*) of the canister (12). The intermediary supports (220) of each of the collapsible rail cars (200) are arranged for collapsing in conjunction with a transition between the first state and the second state when the associated rail car (200) reaches a particular travel position along the storage region (14) of the canister (12). Capture means (410; 430; 700; 1000; 1100) are provided. The capture means (410; 430; 700; 1000; 1100) are one of (a) affixed to at least one of (i) the rail car rail engaging structure (210) and (ii) the missile guidance and/or support structure (212), for capturing the intermediary supports (220) during the transition, thereby tending to prevent substantial rebounding motion of the intermediate supports (220) and the missile guidance and/or support structure (212) toward the missile body (16*b*), and (b) affixed to at least one wall (12*w*) of the storage region (14) and to the missile guidance and/or support structure (220), for mutual capture during the transition, thereby tending to reduce rebounding motion of the missile guidance and/or support structure (212) toward the missile body (16*b*). In a particular version of this missile launch arrangement, the rail engaging structure (210) stops moving toward the missile exit (12*me*) at the particular travel position while the missile guidance and/or support structure (212) continues to move with a component of motion toward the missile exit (12*me*).

In a particular embodiment of a missile launch arrangement, the capture means (410; 430; 700; 1000; 1100) comprises at least one capture link (410) including a base (410abase) connected to the one of (i) the rail engaging structure (210) and (ii) the missile guidance and/or support structure (212) and also including a hook portion (410*ah*2, for example) dimensioned to engage a portion of the intermediary support (220*r*) during the transition between the first state and the second state. The intermediary support (220) may include at least one elongated support member (220*r*, for example), and the hook portion (410*ah*1, 410*ah*2, for example) may be dimensioned to engage an edge portion of the elongated support member (220*r*) of the intermediary support (220) during the transition. In an alternative embodiment, the intermediary support (220) includes at least one elongated support member (920*rw*) defining an aperture (920*rwa*), and the hook portion (1010*ah*, for example) is dimensioned to engage the aperture (920*rwa*).

In another version of the missile launch arrangement, the capture means (410; 430; 700; 1000; 1100) is affixed to one of (i) the rail engaging structure (210) and (ii) the missile guidance and/or support structure (212), and the capture means (410; 430; 700; 1000; 1100) comprises at least one capture link (1000) including a base connected to the one of (i) the rail car support structure and (ii) the missile guidance and/or support structure and also including an enlarged head portion (1010*ah*, for example) dimensioned to engage a portion of the intermediary support (220) during the transition. In yet another version, the capture means (410; 430; 700; 1000; 1100) comprises first (1110) and second (1112) mutually mating halves of a deformable energy absorption device (1100), the first half (1110) of the energy absorption device being affixed to the at least one wall (12*w*) of the storage region (14) and the second half (1112) of the energy absorption device (1100) being affixed to the missile guidance and/or support structure (212), for mutual capture and deformation during the transition, thereby tending to reduce rebounding motion of the missile support structure (212) toward the missile body (16*b*).

What is claimed is:

1. A collapsible structure for controllably guiding a load comprises:

a support structure;

a load guiding structure;

a collapsible support arrangement extending between said support structure and said load guiding structure, said collapsible support arrangement being affixed to said support structure and to said load guiding structure; and a capture arrangement affixed to at least one of (a) said support structure and (b) said load guiding structure, for deforming in conjunction with the collapse of said collapsible support arrangement to absorb energy from the collapse of said load guiding structure toward said support structure and to reduce rebound of said load guiding structure from said support structure, wherein said collapsible support arrangement includes at least one support member adapted to support said load guiding structure in a position generally away from said support structure in a first mode, and allow collapsing motion of said load guiding structure relative to said support structure in a second mode.

2. A collapsible structure according to claim 1, wherein said collapsible structure is part of a railcar in which the support structure is configured to engage with and travel along a rail.

3. A collapsible structure according to claim 1, wherein said capture arrangement comprises an anchor clip affixed to one of (i) said support structure and (ii) said load guiding structure, and said anchor clip comprises at least one capture link including a base connected to said one of (i) said support structure and (ii) said load guiding structure and also including a hook portion dimensioned to engage a portion of said collapsible support arrangement.

4. A collapsible structure according to claim 3, wherein said hook portion is dimensioned to engage an edge portion of said support member of said collapsible support arrangement.

5. A collapsible structure according to claim 3, wherein said collapsible support arrangement defines an aperture therein, and wherein said hook portion is dimensioned to engage said aperture.

6. A collapsible structure according to claim 1, wherein said capture arrangement comprises an anchor clip affixed to one of (i) said support structure and (ii) said load guiding structure, and said anchor clip comprises at least one capture link including a base connected to said one of (i) said support structure and (ii) said load guiding structure, said anchor clip further including an enlarged head portion dimensioned to engage a portion of said collapsible support arrangement.

7. A collapsible structure according to claim 6, wherein the enlarged head portion defines a slot therein.

8. A collapsible structure according to claim 1, wherein said support member comprises a rigid, elongated member adapted to support said load guiding structure in a position generally parallel with said support structure in the first mode.

9. A collapsible structure according to claim 8, wherein said at least one rigid, elongated support member adapted to support said load guiding structure comprises a plurality of rigid, elongated bars hingedly linked to said load guiding structure and said support structure.

10. A collapsible structure according to claim 9, wherein said plurality of rigid, elongated bars hingedly linked to said load guiding structure and said support structure comprise a four bar linkage.

11. A collapsible structure according to claim 1, wherein said capture arrangement comprises an anchor clip that is one of (a) affixed to one of (i) said support structure and (ii) said load guiding structure, for capturing said collapsible support arrangement, thereby reducing rebounding motion of said support structure and said load guiding upon collapse, and (b) affixed to a wall adjacent said support structure and to said load guiding structure, for mutual capture, thereby reducing rebounding motion of said support structure and said load guiding upon collapse.

12. A collapsible structure according to claim 11, wherein said anchor clip comprises first and second mutually mating halves of a deformable energy absorption device, said first half of said energy absorption device being affixed to said wall adjacent said support structure and said second half of said energy absorption device being affixed to said load guiding structure, for mutual capture and deformation, thereby tending to reduce rebounding motion of said support structure and said load guiding upon collapse.

13. A collapsible structure according to claim 12, wherein said first and second mutually mating halves of a deformable energy absorption device comprise corrugated engaging elements configured for mutual engagement and permanent deformation therewith.

14. A missile launch arrangement, comprising:

an elongated canister defining (a) an axis, (b) an elongated storage region about said axis, and (c) a missile egress end, said elongated storage region being dimensioned to accommodate a missile;

a plurality of collapsible cars, each including a car support structure, a missile guidance structure, and a collapsible intermediary support lying between said car support structure and said missile guidance structure, said collapsible intermediary support adapted to hold said car support structure away from said missile guidance structure in a first mode of operation, and to allow said missile guidance structure to approach said car support structure in a second mode of operation, said cars, acting together in said first mode of operation, for guiding a missile as said missile travels toward said egress end of said canister, each of said intermediary supports of said collapsible cars being arranged for collapsing in conjunction with a transition between said first mode of operation and said second mode of operation when the associated car reaches a travel position along said storage region of said canister; and an anchor clip that is one of (a) affixed to one of (i) said car support structure and (ii) said missile guidance structure, for capturing said intermediary support, thereby preventing substantial rebounding motion of said intermediate support and said missile guidance structure toward said elongated storage region axis, and (b) affixed to said at least one wall of said storage region and to said missile guidance structure, for mutual capture, thereby tending to reduce rebounding motion of said missile guidance structure toward said elongated storage region axis.

15. A missile launch arrangement according to claim 14, further comprising at least one rail disposed adjacent at least one wall of said storage region, and further comprising rail-engaging means associated with said car support structure.

16. A missile launch arrangement, comprising:

an elongated canister defining (a) an axis, (b) an elongated storage region about said axis, and (c) a missile egress end, said elongated storage region being dimensioned to accommodate a missile;

a plurality of collapsible railcars, each including a railcar support structure, a missile guidance structure, and a collapsible intermediary support lying between said railcar support structure and said missile guidance structure, said collapsible intermediary support adapted to hold said railcar support structure away from said missile guidance structure in a first mode of operation, and to allow said missile guidance structure to approach said railcar support structure in a second mode of operation, said railcars, acting together in said first mode of operation, for guiding missile in said storage region as said missile travels toward said egress end of said canister, each of said intermediary supports of said collapsible railcars being arranged for collapsing in conjunction with a transition between said first mode of operation and said second mode of operation when the associated railcar reaches a travel position along said storage region of said canister; and an anchor clip that is one of (a) affixed to one of (i) said railcar support structure and (ii) said missile guidance structure, for capturing said intermediary support, thereby preventing substantial rebounding motion of said intermediate support and said missile guidance structure toward said elongated storage region axis, and (b) affixed to said at least one wall of said storage region and to said missile guidance structure, for mutual capture, thereby reducing rebounding motion of said missile guidance support structure toward said elongated storage region axis.

17. A missile launch arrangement according to claim 16, wherein said railcar support structure stops moving toward said missile egress end at said travel position while said missile guidance structure continues to move toward said missile egress end.

18. A missile launch arrangement according to claim 16, wherein at least some of said collapsible intermediary supports are in the form of a pantograph.

19. A missile launch arrangement according to claim 16, wherein:

said anchor clip is affixed to one of (i) said railcar support structure and (ii) said missile guidance structure, and said anchor clip comprises at least one capture link including a base connected to said one of (i) said railcar support structure and (ii) said missile guidance structure and also including a hook portion dimensioned to engage a portion of said intermediary support.

20. A missile launch arrangement according to claim 19, wherein said intermediary support includes at least one elongated support member, and said hook portion is dimensioned to engage an edge portion of said elongated support member of said intermediary support.

21. A missile launch arrangement according to claim 19, wherein:

said intermediary support includes at least one elongated support member defining an aperture; and said hook portion is dimensioned to engage said aperture.

22. A missile launch arrangement according to claim 16, wherein:

said anchor clip is affixed to one of (i) said railcar support structure and (ii) said missile guidance structure, and said anchor clip comprises at least one capture link including a base connected to said one of (i) said railcar support structure and (ii) said missile guidance structure and also including an enlarged head portion dimensioned to engage a portion of said intermediary support.

23. A missile launch arrangement according to claim 16, wherein:

said anchor clip comprises first and second mutually mating halves of a deformable energy absorption device, said first half of said energy absorption device being affixed to said at least one wall of said storage region and said second half of said energy absorption device being affixed to said missile guidance structure, for mutual capture and deformation, thereby tending to reduce rebounding motion of said missile support structure toward said elongated storage region axis.

24. A missile launch arrangement, comprising:

an elongated canister defining (a) an axis, (b) an elongated storage region about said axis, and (c) a missile egress end, said elongated storage region being dimensioned to accommodate a missile;

a plurality of collapsible cars, each including a car support structure, a missile engaging structure, and a collapsible intermediary support, said collapsible intermediary support adapted to hold said car support structure away from said missile engaging structure in a first mode of operation, and to allow said missile engaging structure to approach said car support structure in a second mode of operation, each of said collapsible cars lying between at least one wall of said storage region and said cylindrical body, with said car support structure adjacent said at least one wall of said storage region, said cars, acting together in said first mode of operation, for guiding a missile generally centered about said axis in said storage region as said missile travels toward said egress end of said canister, each of said intermediary supports of said collapsible cars being arranged for collapsing in conjunction with a transition between said first mode of operation and said second mode of operation when the associated car reaches a particular travel position along said storage region of said canister; and an anchor clip that is one of (a) affixed to one of (i) said car support structure and (ii) said missile engaging structure, for capturing said intermediary support, thereby preventing substantial rebounding motion of said intermediate support and said missile engaging structure toward said elongated storage region axis, and (b) affixed to said at least one wall of said storage region and to said missile engaging structure, for mutual capture, thereby reducing, rebounding motion of said missile engaging structure toward said elongated storage region axis.

25. A missile launch arrangement according to claim 24, wherein said anchor clip comprises first and second mutually mating halves of a deformable energy absorption device, said first half of said energy absorption device being affixed to said at least one wall of said storage region and said second half of said energy absorption device being affixed to said missile guidance structure, for mutual capture and deformation, thereby tending to reduce rebounding motion of said missile support structure toward said elongated storage region axis.

26. A missile launch arrangement according to claim 24, wherein said anchor clip comprises at least one capture link including a base connected to said one of (i) said railcar support structure and (ii) said missile guidance structure and also including a hook portion dimensioned to engage a portion of said intermediary support.

* * * * *